US008226219B2

(12) United States Patent
Umeda

(10) Patent No.: US 8,226,219 B2
(45) Date of Patent: Jul. 24, 2012

(54) LIQUID-DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 902 days.

(21) Appl. No.: 12/130,498

(22) Filed: May 30, 2008

(65) Prior Publication Data

US 2008/0297579 A1 Dec. 4, 2008

(30) Foreign Application Priority Data

May 31, 2007 (JP) ..... 2007-145462
Sep. 27, 2007 (JP) ..... 2007-252387

(51) Int. Cl.
*B41J 2/17* (2006.01)
*B41J 2/175* (2006.01)

(52) U.S. Cl. ..... 347/85; 347/84; 347/92

(58) Field of Classification Search ..... 347/6, 7, 347/19, 66, 84, 85, 92, 93
See application file for complete search history.

(56) References Cited

U.S. PATENT DOCUMENTS

| | | | | |
|---|---|---|---|---|
| 5,880,748 | A * | 3/1999 | Childers et al. | 347/6 |
| 6,637,872 | B2 * | 10/2003 | Ara et al. | 347/85 |
| 7,794,032 | B2 * | 9/2010 | Kimura | 347/7 |
| 2006/0001715 | A1 * | 1/2006 | Umeda et al. | 347/86 |
| 2006/0139419 | A1 | 6/2006 | Shigemura | |
| 2006/0203047 | A1 | 9/2006 | Koga et al. | |
| 2006/0290751 | A1 | 12/2006 | Taniguchi et al. | |
| 2007/0046747 | A1 * | 3/2007 | Takemoto | 347/92 |

FOREIGN PATENT DOCUMENTS

| | | | |
|---|---|---|---|
| EP | 0 684 136 | A | 11/1995 |
| JP | H06-079881 | A | 3/1994 |
| JP | 2000-301732 | A | 10/2000 |
| JP | 2002-052737 | A | 2/2002 |
| JP | 2002-192743 | A | 7/2002 |
| JP | 2002-331233 | A | 11/2002 |
| JP | 2004-009450 | A | 1/2004 |
| JP | 2005-288770 | A | 10/2005 |
| JP | 2006-247936 | A | 9/2006 |
| JP | 2006-327097 | A | 12/2006 |
| JP | 2007-001209 | A | 1/2007 |

OTHER PUBLICATIONS

European Patent Office, European Search Report for Application No. EP 08 00 9858 (counterpart to above-captioned patent application), mailed Sep. 30, 2008.
Japan Patent Office, Decision to Grant a Patent for Japanese Patent Application No. 2007-252387 (counterpart to above-captioned patent application), dispatched Jan. 24, 2012.

* cited by examiner

*Primary Examiner* — Matthew Luu
*Assistant Examiner* — Renee I Wilson
(74) *Attorney, Agent, or Firm* — Baker Botts L.L.P.

(57) ABSTRACT

A liquid-droplet ejecting apparatus including a liquid ejecting head having an ejection opening, a liquid supply passage, a first suction passage normally held in communication with the liquid supply passage, a sucking device sucking a gas in the liquid supply passage via the first suction passage, a gas-permeable film, a gas tank which is disposed in a portion of the first suction passage between the sucking device and the liquid supply passage, and a check valve which is disposed in a portion of the first suction passage between the sucking device and the gas tank, and allows the gas to flow in a first direction from the liquid supply passage to the sucking device, but does not allow the gas to flow in a second direction opposite to the first direction.

17 Claims, 21 Drawing Sheets

LIQUID-DROPLET EJECTING APPARATUS

CROSS REFERENCE TO RELATED APPLICATION

The present application claims priority from Japanese Patent Application Nos. 2007-145462 and 2007-252387 fled on May 31, 2007 and Sep. 27, 2007, respectively, the disclosure of which is herein incorporated by reference in their entirety.

BACKGROUND OF THE INVENTION

1. Field of the Invention

The present invention relates to a liquid-droplet ejecting apparatus, and particularly to a liquid-droplet ejecting apparatus including a gas-permeable film.

2. Description of Related Art

Some of the liquid-droplet ejecting apparatuses including a liquid ejecting head for ejecting droplets of a liquid, such as inkjet printer, further include a liquid supply passage through which the liquid is supplied to the liquid ejecting head, as disclosed in JP-A-2005-288770 (see especially FIG. 2). The apparatus disclosed in this publication includes a carriage, a recording head mounted on the carriage, a sub tank, an ink cartridge, and a suction pump. The ink cartridge stores an ink to be supplied to the recording head via the sub tank and an ink supply passage.

The sub tank in this apparatus has a gas-permeable film. The gas-permeable film does not allow the ink to pass therethrough, but selectively allows gas or air to pass therethrough. By having the suction pump suck a gas or an air from an inside of the sub tank through the gas-permeable film, the sub tank is depressurized, or an internal pressure of the sub tank is decreased, thereby introducing the ink from the ink cartridge into the inside of the sub tank. Further, after the apparatus is turned off, the gas or air suction from the inside of the sub tank is implemented in order to have the gas or air bubbles flown out of the ink. Thus, the gas or air contained in the ink stored in the sub tank is separated from the ink, or "gas-liquid separation" is implemented on the ink in the sub tank, so as to inhibit inflow of the gas or air into the liquid ejecting head.

In this apparatus, however, after once implemented at the time of introduction of the ink into the sub tank, the gas or air suction from the sub tank is not performed until the apparatus is turned off. Hence, when the recording head is operated to record an image after the introduction of the ink into the sub tank, gas or air bubbles continue to occur in the ink and accumulate in the sub tank, adversely affecting the depressurized state of the sub tank and accordingly inhibiting separation of the gas or air bubbles from the ink. The thus invited insufficiency in the gas-liquid separation in the sub tank may result in undesirable inflow of the gas or air together with the ink into the liquid ejecting head.

SUMMARY OF THE INVENTION

This invention has been developed in view of the above-described situations, and it is an object of the invention, therefore, to provide a liquid-droplet ejecting apparatus that includes a liquid ejecting head and a liquid supply passage through which a liquid is supplied to the liquid ejecting head, and is able to easily hold the liquid supply passage in a state where a gas or an air is separated from the liquid in a sufficient degree.

To attain the above object, the invention provides a liquid-droplet ejecting apparatus in the following modes.

(1) A liquid-droplet ejecting apparatus including:

a liquid ejecting head having an ejection opening from which a droplet of a liquid is ejected;

a liquid supply passage through which the liquid is supplied to the liquid ejecting head;

a first suction passage normally held in communication with the liquid supply passage;

a sucking device which sucks a gas in the liquid supply passage via the first suction passage;

a gas-permeable film disposed at a communication portion at which the liquid supply passage and the first suction passage communicate with each other, the gas-permeable film allowing the gas to pass therethrough but not allowing the liquid to pass therethrough;

a gas tank which is disposed in a portion of the first suction passage between the sucking device and the liquid supply passage, and accommodates the gas to accumulate a suction pressure to suck the gas; and a check valve which is disposed in a portion of the first suction passage between the sucking device and the gas tank, and allows the gas to flow in a first direction from the liquid supply passage to the sucking device, but does not allow the gas to flow in a second direction opposite to the first direction.

According to this liquid-droplet ejecting apparatus, the liquid supply passage can be kept in the state where the gas-liquid separation is achieved, not only while the sucking device is operated but also after the operation of the sucking device is ceased. Hence, the sucking the gas by means of the sucking device efficiently performed. Further, the gas can be separated from the liquid in the liquid supply passage even when an operation of the sucking device is ceased or terminated during a liquid-droplet ejecting operation such as a recording operation. Hence, even when the gas is introduced into the liquid supply passage after initiation of a liquid-droplet ejecting operation subsequent to a sucking operation by the sucking device, the gas can be removed to maintain the high accuracy of liquid-droplet ejection such as the quality of recording. That is, when the gas and the liquid are to be separated from each other in the liquid supply passage, the sucking device is operated to suck the gas from the liquid supply passage. After termination of the operation of the sucking device, the check valve operates to keep the inside of the first suction passage in the state where a sufficient suction pressure is applied. When a liquid-droplet ejecting operation is initiated thereafter, droplets of the liquid are ejected from the ejection opening of the liquid ejecting head and an amount of the liquid moves into the liquid supply passage to replenish the liquid used. This may cause introduction of the gas into the liquid supply passage. However, since the first suction passage is kept in the state where the sufficient suction pressure is applied, the gas thus introduced is separated from the liquid. In this way, the liquid-droplet ejecting apparatus of the invention can keep the liquid supply passage in the state where the gas-liquid separation is achieved even after termination of an operation of the sucking device.

(2) The apparatus according to the mode (1), wherein the check valve includes a valve element movable between an opening position to open the first suction passage and a closing position to close the first suction passage, in accordance with a difference between a pressure acting from the side of the sucking device and a pressure acting from the side of the liquid supply passage.

By employing such a valve element, the check valve can be simply formed.

(3) The apparatus according to the mode (1) or (2), further including:

an ejection-opening capping device which includes a cap movable relative to the liquid ejecting head, between a covering position to closely contact the liquid ejecting head in order to air-tightly cover the ejection opening, and an uncovering position to uncover the ejection opening;

a second suction passage having two opposite ends, one of the two opposite ends being in communication with an internal space of the cap, and the sucking device sucks the gas from the other of the two opposite ends;

a switching device which selectively connects the sucking device with one of the first suction passage and the second suction passage; and a suction controller which controls the ejection-opening capping device, the sucking device, and the switching device so as to implement an ejection-opening suction processing in which the liquid in the liquid ejecting head is sucked from the ejection opening and via the second suction passage, and controls the sucking device and the switching device so as to implement a passage suction processing in which the gas is sucked from the liquid supply passage via the first suction passage.

According to the liquid-droplet ejecting apparatus of the mode (3), the ejection-opening suction processing and the passage suction processing can be selectively implemented by use of a single sucking device. (4) The apparatus according to the mode (3), further including a pressure detecting device which detects whether an internal pressure of the first suction passage is below a first predetermined threshold or not, and wherein the suction controller controls at least one of the ejection-opening capping device, the sucking device, and the switching device on the basis of a result of the detection by the pressure detecting device.

According to the liquid-droplet ejecting apparatus of the mode (4), on the basis of whether a sufficient suction pressure is applied to the liquid supply passage with the internal pressure of the first suction passage being below the first predetermined threshold, the ejection-opening suction processing or the passage suction processing is implemented, or a processing to be implemented is switched from one of the ejection-opening suction processing and the passage suction processing to the other thereof. Hence, it is enabled to control to prevent that the passage suction processing is terminated or the ejection-opening suction processing is initiated before the gas is sufficiently sucked from the liquid supply passage.

(5) The apparatus according to the mode (4), wherein the first suction passage has a tube, at least a part of which is formed of an elastic material, wherein the pressure detecting device includes a detected member which is disposed adjacent to the part of the tube, and a sensor which detects whether the detected member is located at a predetermined detection position, and wherein the tube expands to push the detected member toward the detection position when an internal pressure thereof becomes relatively high.

According to the liquid-droplet ejecting apparatus of the mode (5), the sensor detects whether the detected member is at the detection position. Based on the result of this detection, whether the internal pressure of the first suction passage is below the first predetermined threshold or not is detectable.

(6) The apparatus according to the mode (4) to (5), further including:

a liquid tank from which the liquid is supplied to the liquid supply passage; and a remaining-amount determining portion which has the suction controller implement the passage suction processing when the pressure detecting device detects that the internal pressure of the first suction passage is not below the first predetermined threshold, the remaining-amount determining portion determining that the liquid tank is empty when the pressure detecting device again detects that the internal pressure of the first suction passage is not below the first predetermined threshold after the implementation of the passage suction processing by the suction controller.

When the internal pressure of the first suction passage becomes equal to or above the first predetermined threshold, it can be assumed that the liquid in the liquid tank is depleted and thus the gas flows into the liquid supply passage from the liquid tank, or that the liquid in the liquid tank is not yet depleted but the gas flows into the liquid supply passage only momentarily. Hence, when the passage suction processing is implemented and the pressure detecting device thereafter detects that the internal pressure of the first suction passage is still equal to or above the first predetermined threshold, it is highly probable that the liquid in the liquid tank is depleted. Thus, according to the liquid-droplet ejecting apparatus of the mode (6), whether the liquid in the liquid tank is depleted or not is determinable with high accuracy.

(7) The apparatus according to the mode (6), including a plurality of the liquid tanks and a plurality of remaining-amount detecting devices provided to the respective liquid tanks in order to detect whether amounts of the liquid in the respective liquid tanks are below a threshold near zero, and wherein the remaining-amount determining portion has the suction controller implement the passage suction processing when the pressure detecting device detects that the internal pressure of the first suction passage is not below the first predetermined threshold, the remaining-amount determining portion determining that one of the liquid tanks is empty, when the pressure detecting device detects that the internal pressure of the first suction passage is not below the first predetermined threshold even after the implementation of the passage suction processing by the suction controller, and one of the remaining-amount detecting devices corresponding to the one liquid tank detects that an amount of the liquid remaining in the one liquid tank is below the threshold.

Where a plurality of the liquid tanks are provided, whether at least one of the liquid tanks is empty or all the liquid tanks are not empty is detectable on the basis of the detected internal pressure of the first suction passage, but which liquid tank is empty can not be identified on the basis of the detected internal pressure only. According to the liquid-droplet ejecting apparatus of the mode (7), however, the remaining-amount detecting devices are provided to the respective liquid tanks in order to detect whether the amounts of the liquid in the respective liquid tanks are below the threshold, and when any one of the remaining-amount detecting devices detects that the amount of the liquid in the corresponding one of the liquid tanks is below the threshold, the one liquid tank is highly likely empty and thus determined to be empty. In this way, according to the mode (7), even where a plurality of the liquid tanks are provided or used, which liquid tank becomes empty can be determined with high accuracy.

(8) The apparatus according to any one of the modes (4)-(7), wherein the pressure detecting device includes a gas-flow rate detector which detects a gas flow rate in the first suction passage, the pressure detecting device detecting the internal pressure of the first suction passage on the basis of the gas flow rate which is detected by the gas-flow rate detector when the sucking device sucks the gas via the first suction passage.

The internal pressure of the first suction passage that corresponds to the gas flow rate in the first suction passage can be detected by detecting the gas flow rate.

(9) The apparatus according to the mode (8), wherein the gas-flow rate detector includes a vane wheel which rotates in accordance with the gas flow in the first suction passage, and a rotation-amount detecting portion which detects an amount of rotation of the vane wheel per unit time.

(10) The apparatus according to the mode (8) or (9), wherein the suction controller continues the passage suction processing until the gas-flow rate detector detects that the gas flow rate becomes below a threshold that corresponds to the first predetermined threshold for the internal pressure.

By continuing sucking the gas via the first suction passage until the gas flow rate becomes below a threshold that corresponds to the first predetermined threshold for the internal pressure of the first suction passage, it is enabled to suck the gas via the first suction passage until the internal pressure of the first suction passage becomes below the predetermined threshold.

(11) The apparatus according to any one of the modes (8)-(10), further including:

a liquid tank from which the liquid is supplied to the liquid supply passage; and a remaining-amount determining portion which determines an amount of the liquid remaining in the liquid tank, and wherein the remaining-amount determining portion determines that the liquid tank is empty when the gas flow rate in the first suction passage as detected by the gas-flow rate detector does not decrease although the sucking device continues sucking the gas via the first suction passage.

According to the liquid-droplet ejecting apparatus of the mode (11), it is detected that the liquid tank is empty on the basis of that the gas flow rate does not decrease. Hence, it is enabled to detect with a simple structure that the liquid tank is empty.

(12) The apparatus according to any one of the modes (4)-(11), wherein the suction controller includes an ejection-opening suction permitting portion which permits to implement the ejection-opening suction processing, when the pressure detecting device detects that the internal pressure of the first suction passage is below the first predetermined threshold.

According to the liquid-droplet ejecting apparatus of the mode (12), implementation of the ejection-opening suction processing is permitted when the internal pressure of the first suction passage is below the first predetermined threshold. Hence, the ejection-opening suction processing is initiated in a state where the gas is sufficiently sucked from the liquid supply passage. Thus, it is further reliably prevented that the gas flows from the liquid supply passage to the ejection opening during the ejection-opening suction processing.

(13) The apparatus according to the mode (12), wherein when the pressure detecting device detects that the internal pressure of the first suction passage is not below the first predetermined threshold, the suction controller controls to implement the passage suction processing previous to the ejection-opening, suction processing.

(14) The apparatus according to any one of the modes (1)-(13), wherein the first suction passage includes a pressure limiter which closes the first suction passage when the internal pressure within the first suction passage decreases to a second predetermined threshold lower than the first predetermined threshold.

According to the liquid-droplet ejecting apparatus of the mode (14), the pressure limiter closes the first suction passage when the internal pressure of the first suction passage excessively decreases. Thus, it is prevented that an excessive load is imposed on the gas-permeable film due to excessive sucking of the gas via the first suction passage.

(15) The apparatus according to the mode (14), wherein the pressure limiter comprises a portion of the first suction passage which is flattened by a difference between the internal pressure and an external pressure of the portion of the first suction passage so as to close the first suction passage when the internal pressure of the first suction passage decreases to the second predetermined threshold.

(16) The apparatus according to any one of the modes (1)-(15), further including a pressure detecting device which detects whether an internal pressure of the first suction passage is below a first predetermined threshold or not, and a recording controller which implements a recording processing by ejecting a droplet of the liquid from the ejection opening, the recording controller including a recording permitting portion which permits to implement the recording processing when the pressure detecting device detects that the internal pressure of the first suction passage becomes below the first predetermined threshold.

According to the liquid-droplet ejecting apparatus of the mode (16) where implementation of the recording processing is permitted when the internal pressure of the first suction passage is below the first predetermined threshold, the recording processing is initiated in a state where the gas is sufficiently sucked from the liquid supply passage. Thus, it is further reliably prevented that the gas flows from the liquid supply passage to the ejection opening during the recording processing.

(17) The apparatus according to the mode (16), wherein when the pressure detecting device detects that the internal pressure of the first suction passage is not below the first predetermined threshold, the suction controller has the sucking device suck the gas from the liquid supply passage before the recording controller starts the recording processing.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

Figure 1:
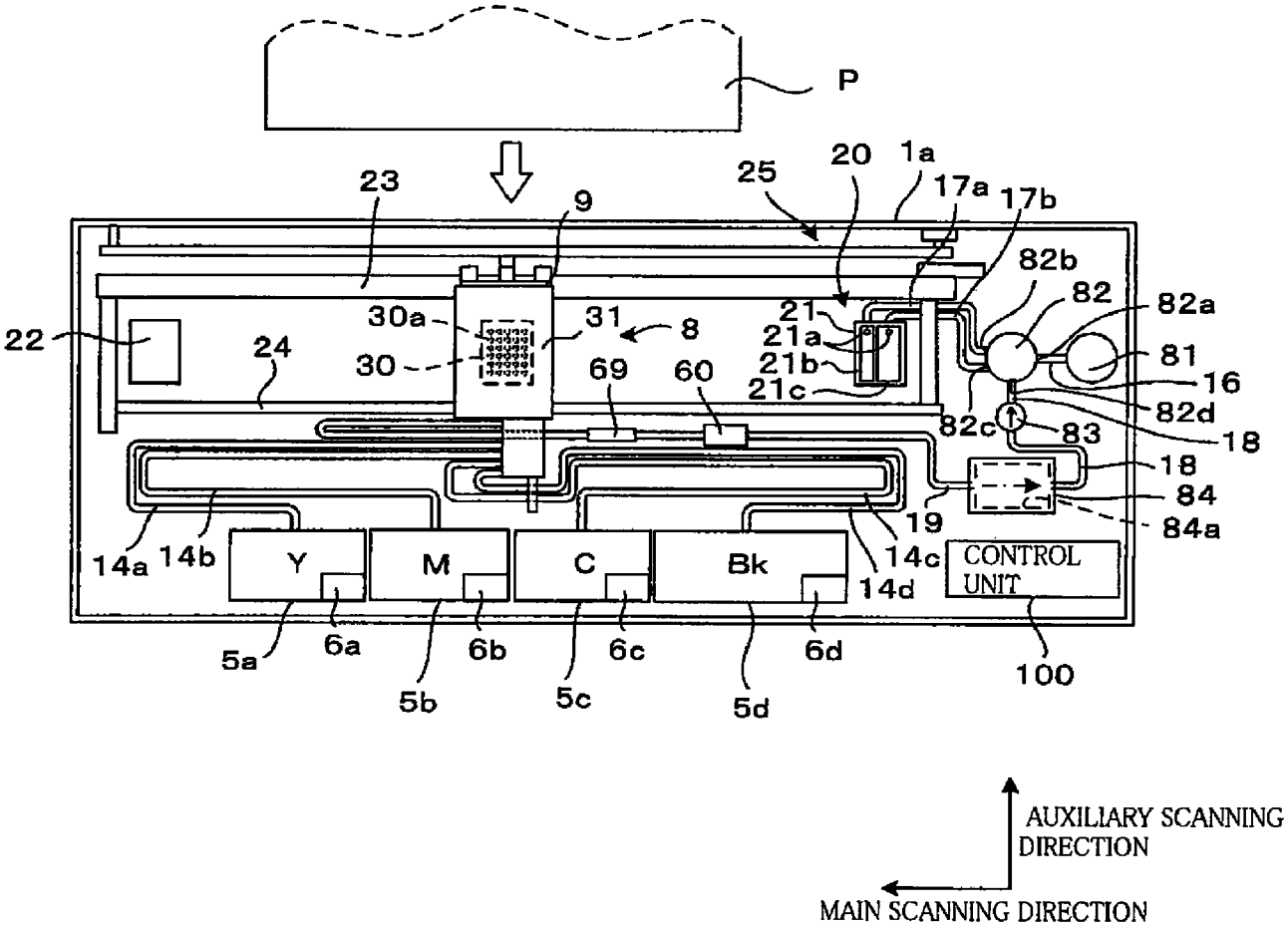
FIG. 1 is a plan view of an inkjet printer according to a first embodiment of the invention.

With reference to FIGS. 1-11, there will be described an inkjet printer according to a first embodiment of the invention. FIG. 1 is a schematic plan view of the inkjet printer denoted by reference numeral 1. In the following description, a main scanning direction and an auxiliary scanning direction are a lateral direction and a vertical direction as seen in FIG. 1, respectively.

The inkjet printer 1 includes an inkjet head 8 as a form of a liquid ejecting head of the invention. The inkjet head 8 ejects droplets of ink as a form of a liquid of the invention. The inkjet head 8 has a carriage 9 and a head mainbody 30 fixed on the carriage 9. At a lower or under surface of the head mainbody 30 are formed a plurality of nozzles 30*a* (as ejection openings), from which ink droplets are ejected. The head mainbody 30 is fixed on the carriage 9 with the nozzles 30*a* exposed or open downward. On an upper surface of the head mainbody 30, a sub tank 31 (described later) is fixed.

In the inkjet printer 1, guide frames 23 and 24 are disposed side by side with a spacing therebetween in the auxiliary scanning direction and extend parallel to the main scanning direction. The carriage 9 is disposed across the guide frames 23, 24 to be reciprocable on the guide frames 23, 24 along the main scanning direction. The inkjet printer 1 further includes a main frame 1*a*, in which a carriage moving device 25 is disposed. The carriage moving device 25 has a drive motor for reciprocating the carriage 9 in the main scanning direction.

The inkjet printer 1 further includes main tanks 5*a*-5*d* (as liquid tanks) from which ink is supplied to the head mainbody 30. More specifically, the main tanks 5*a*-5*d* store inks of respective colors, namely, yellow (Y), magenta CM), cyan (C), and black (Bk).

In the main tanks 5*a*-5*d*, remaining-amount detecting devices 6*a*-6*d* (as remaining-amount detecting devices) are respectively disposed for detecting amounts of the inks remaining in the main tanks 5*a*-5*d*. Each remaining-amount detecting device 6*a*-6*d* detects the amount of the remaining ink in the corresponding main tank 5*a*-5*d*, and sends a control unit 100 (described later) a result of the detection that indicates whether the amount of the remaining ink in the main tank 5*a*-5*d* is smaller than a predetermined threshold that is set at a value nearly zero. That is, when the amount of the remaining ink is equal to the threshold, the corresponding tank is not completely empty or depleted and contains an amount of the ink that enables some image recording. For instance, the remaining-amount detecting device 6*a*-6*d* is constituted by a float and a shield plate that are disposed in the tank 5*a*-5*d*, and an optical sensor. The shield plate vertically moves with the float, in accordance with a shift of a level of the ink surface. As the ink surface lowers, the shield plate passes the detection position, which is detected by the optical sensor. Upon detecting the passing of the detection position by the shield plate, the optical sensor outputs a signal representative thereof to the control unit 100.

The inks stored in the main tanks 5*a*-5*d* are first supplied to the sub tank 31 via respective ink tubes 14*a*-14*d* and stored there, and thereafter supplied to the head mainbody 30. Thus, in this embodiment the ink tubes 14*a*-14*d* and the sub tank 31 cooperate to constitute an ink supply passage, through which the inks are supplied from the main tanks 5*a*-5*d* to the head mainbody 30, and which is a form of a liquid supply passage of the invention. The inks supplied to the head mainbody 30 are downward ejected from the nozzles 30*a*. The inkjet printer 1 further includes a medium feed device 26 (shown in FIG. 3). The medium feed device 26 operates to feed a recording medium P to a recording position under the guide frames 23 and 24. Onto the recording medium P thus located at the recording position, droplets of the inks are ejected from the head mainbody 30.

Between the guide frames 23 and 24, an absorbing member 22 is disposed. The absorbing member 22 is located at a position near one of two opposite ends (i.e., a left end as seen in FIG. 1) of the guide frames 23 and 24 with respect to the main scanning direction. By moving the carriage 9 in the main scanning direction, the head mainbody 30 can be located just over the absorbing member 22. The absorbing member 22 is formed of a porous material such as urethane foam, and capable of absorbing the inks ejected from the head mainbody 30. The control unit 100 has the carriage 9 move to the position just over the absorbing member 22, and has the head mainbody 30 eject ink droplets that are absorbed by the absorbing member 22. In this way, a flushing processing for flushing the nozzles 30*a* is implemented.

In the inkjet printer 1, a capping device 20, which is a form of an ejection-opening capping device of the invention, is disposed for maintenance of an area in the lower surface of the inkjet head 8 across which the nozzles 30*a* are arranged. The capping device 20 has a suction cap 21 that is a form of a cap of the invention and disposed to be located just under the head mainbody 30 when the carriage 9 is moved to a predetermined maintenance position, which is disposed at a position near right ends of the guide frames 23 and 24 as seen in FIG. 1.

Two upward protrusions 21*b* and 21*c* are formed on an upper surface of the suction cap 21. Each of the upward protrusions 21*b* and 21*c* takes the form of a wall surrounding a rectangular region in plan view. While the carriage 9 is at the maintenance position, the upward protrusions 21*b* and 21*c* surround respective groups of nozzles 30*a* each arranged on the lower surface of the head mainbody 30 in plan view.

The suction cap 21 is disposed in the inkjet printer 1 such that while the carriage 9 is at the maintenance position, the suction cap 21 can be vertically moved. More specifically, the suction cap 21 is movable between a covering position to have the upward protrusions 21*b*, 21*c* in close contact with the lower surface of the head mainbody 30 so as to cover the nozzles 30*a*, and an uncovering position to have the upward protrusions 21*b*, 21*c* downward retract or separate from the lower surface of the head mainbody 30 to uncover the nozzles 30*a*. The capping device 20 has a moving mechanism (not shown) for moving the suction cap 21 between the covering and uncovering positions. Two suction openings 21*a* are formed in the upper surface of the suction cap 21 in respective areas that are surrounded by the upward protrusions 21*b*, 21*c* in plan view. That is, the area surrounded by the upward protrusion 21*b* corresponds to nozzles 30*a* from which a pigmented ink or inks (e.g., that of Bk) is/are ejected, and the area surrounded by the protrusion 21*c* corresponds to nozzles 30*a* from which a dye ink or inks (e.g., those of Y, M, and C) is/are ejected, in order that the pigmented ink(s) and the dye ink(s) can be sucked independently of each other.

The inkjet printer 1 further includes a suction pump 81, which is a form of a sucking device of the invention, and a flow-path switching device 82, which is a form of a switching device of the invention. The suction pump 81 and the flow-path switching device 82 are connected with each other via an air tube 16. The flow-path switching device 82 has first to fourth ports 82*a*-82*d*. The first port 82*a* is connected with one end of the air tube 16, the second port 82*b* is connected with one end of an air tube 17*a*, the third port 82*c* is connected with one end of an air tube 17*b*, and the fourth port 82*d* is connected with one end of an air tube 18. The other ends of the air tubes 17*a* and 17*b* are respectively connected with the suction openings 21*a* of the suction cap 21. The flow-path switching device 82 can selectively communicate the first port 82*a* with one of the second to fourth ports 82*b*-82*d*. Thus, for instance, by communicating the first port 82*a* with the second port 82*d*, a state where the suction pump 81 can suck the air from one of the suction openings 21*a* via the air tubes 16 and 17*a* is established, and by communicating the first port 82*a* with the third port 82*c*, a state where the suction pump 81 can suck from the other suction opening 21*a* via the air tubes 16 and 17*b* is established.

The other end of the air tube 18 is connected with a charge tank 84 as a form of a gas tank of the invention. When the suction pump 81 operates to suck the air, the charge tank 84 along with an air chamber 51 (described later) operates to accumulate pressure. In the charge tank 84 is defined an internal space 84*a*, one of two opposite ends of which is in communication with the air tube 18. The other end of the internal space 84*a* is in communication with one end of an air tube 19. A cross-sectional area of the internal space 84*a*, which is perpendicular to a direction of air flow in the internal space 84*a* as indicated by one-dot chain line in FIG. 1, i.e., from one of the two ends of the internal space 84*a* to the other end, is larger than cross-sectional areas of the air tubes 18 and 19, which areas are perpendicular to directions of extension of the air tubes 18, 19. On the other hand, the other end of the air tube 19 is connected with the sub tank 31.

Figure 2:
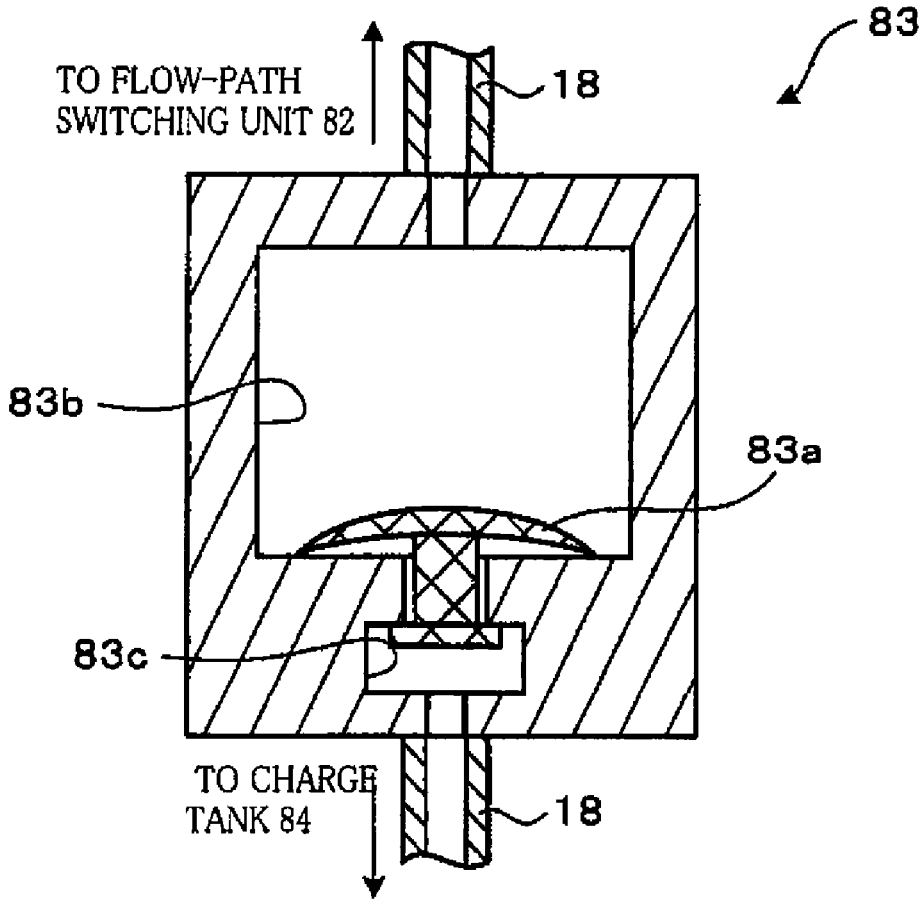
FIG. 2 is a cross-sectional view of a check valve of the inkjet printer.

At a point in the air tube 18, a check valve 83 is disposed. FIG. 2 shows one example of the check valve 83, in which are formed a first valve chamber 83*b* and a second valve chamber 83*c* that are in communication with the air tube 18, on the side of the flow-path switching device 82 and on the side of the charge tank 84, respectively. In the first and second valve chambers 83*b* and 83*c*, a valve element 83*a* is accommodated. The valve element 83*a* has a bevel portion, which deforms in accordance with a pressure difference between an internal pressure of the first valve chamber 83*b* and that of the second valve chamber 83*c*. When the suction pump 81 sucks the air from the air tube 18 to decrease the internal pressure of the first valve chamber 83*b* to a degree such that a sucking force acting from the first valve chamber 83*b* overcomes a sucking force acting from the second valve chamber 83*c*, the valve element 83*a* is located at an opening position to open a communication portion at which the first and second valve chambers 83*b*, 83*c* can communicate with each other. When the suction pump 81 stops sucking the air from the air tube 18 to increase the internal pressure of the first valve chamber 83*b* so as to decrease the sucking force from the first valve chamber 83*b* to a degree such that the sucking force acting from the second valve chamber 83*c* overcomes the sucking force acting from the first valve chamber 83*b*, the valve element 83*a* moves to a closing position to close the communication portion between the first and second valve chambers 83*b*, 83*c*, thereby disconnecting the communication therebetween.

Thus, when the suction pump 81 sucks the air from the air tube 18, the valve element 83*a* is located at the opening position, that is, the check valve 83 is placed in an open state, and when the suction pump 81 stops sucking the air from the air tube 18, the valve element 83*a* is moved to the closing position, that is, the check valve 83 is placed in a closed state. In this way, the check valve 83 controls air flow in the air tube 18 such that the air flows only in a direction from the charge tank 84 to the flow-path switching device 82.

In the air tube 19, there are disposed at respective points a pressure detecting device 60 as a form of a pressure detecting device of the invention, and a pressure limiter 69 (both described later). The pressure detecting device 60 can detect a level of an internal pressure of the air tube 19, and the pressure limiter 69 operates when the internal pressure of the air tube 19 extremely decreases.

As described above, the sub tank 31 and the flow-path switching device 82 are communicated with each other via the air tube 19, the charge tank 84, and the air tube 18. The air tubes 18, 19 and the charge tank 84 cooperate to constitute a first suction passage of the invention. By having the flow-path switching device 82 communicate the first port 82*a* with the fourth port 82*d*, a state where the suction pump 81 can suck the air from the sub tank 31 via the air tubes 16, 18, the charge tank 84, and the air tube 19 is established.

Figure 3:
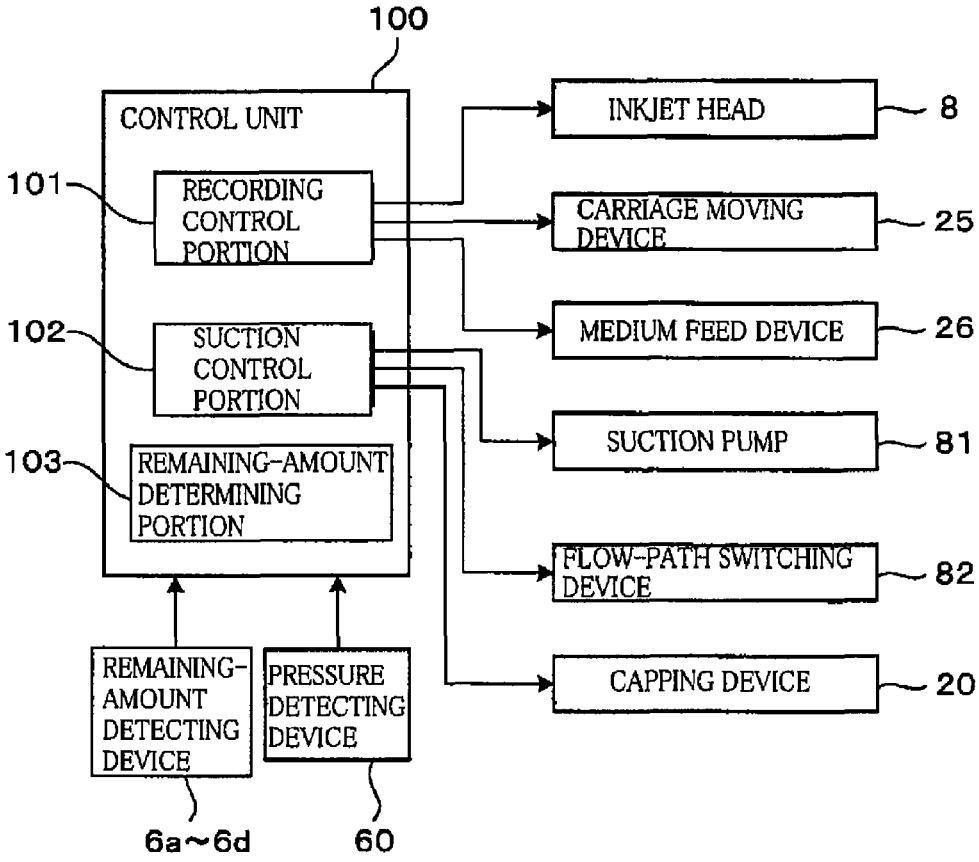
FIG. 3 is a block diagram showing an electrical structure of the inkjet printer.

The inkjet printer 1 further includes the control unit 100 for controlling various kinds of operations of the inkjet printer 1. That is in the inkjet printer 1 is installed hardware such as a processor circuit and various kinds of storage devices for storing various kinds of software including programs for operating the processor circuit, and a combination of the hardware and the software constitutes the control unit 100. As shown in FIG. 3, the control unit 100 includes a recording control portion 101 (as a recording controller), which controls a recording operation implemented by the inkjet printer 1 to form on a recording medium an image, which includes character, symbol, and graphic. That is, the recording operation is implemented with the recording control portion 101 controlling feeding of a recording medium by the medium feed device 26, movement of the carriage 9 by the carriage moving device 25, and ejection of ink droplets from the inkjet head 8, on the basis of image data. The control unit 100 further includes a suction control portion 102 (as a suction controller), which controls a sucking operation implemented by operating the suction pump 81. The suction control portion 102 switches the state of the flow-path switching device 82 between a state where the air in the sub tank 31 can be sucked and a state where the air inside the suction cap 21 can be sucked. The suction control portion 102 moves the capping device 20 between the covering position to cover the nozzles 30*a* and the opening position to uncover the nozzles 30*a*. Further, the suction control portion 102 controls an operation of the suction pump 81. By these operations, the suction control portion 102 implements a sucking operation for sucking the inside of the sub tank 31 or for sucking the inside of the nozzles 30*a*. The control unit 100 further includes a remaining-amount determining portion 103 that determines the amounts of the inks remaining in the main tanks 5*a*-5*d*.

The control unit 100 receives the results of the detection by the remaining-amount detecting devices 6*a*-6*d* and the detection by the pressure detecting device 60. Based on the received results, the control unit 100 controls a recording operation and a sucking operation. It may be arranged such that when the result of the detection outputted from any of the remaining-amount detecting devices 6*a*-6*d* indicates that the amount of the ink remaining in the main tank 5*a*-5*d* in which the remaining-amount detecting device 6*a*-6*d* is disposed is nearly zero, the control unit 100 presents a message indicating this fact on a display device (not shown). At the moment the result outputted from the remaining-amount detecting device 6*a*-6*d* first indicates that the amount of the ink remaining in the main tank 5*a*-5*d* being nearly zero, the control unit 100 starts counting the number of times the inkjet head 8 ejects a droplet of the ink stored in the main tank 5*a*-5*d* in question. This number of times of ejection is used in a remaining-amount determination processing which will be described later.

Figure 4:
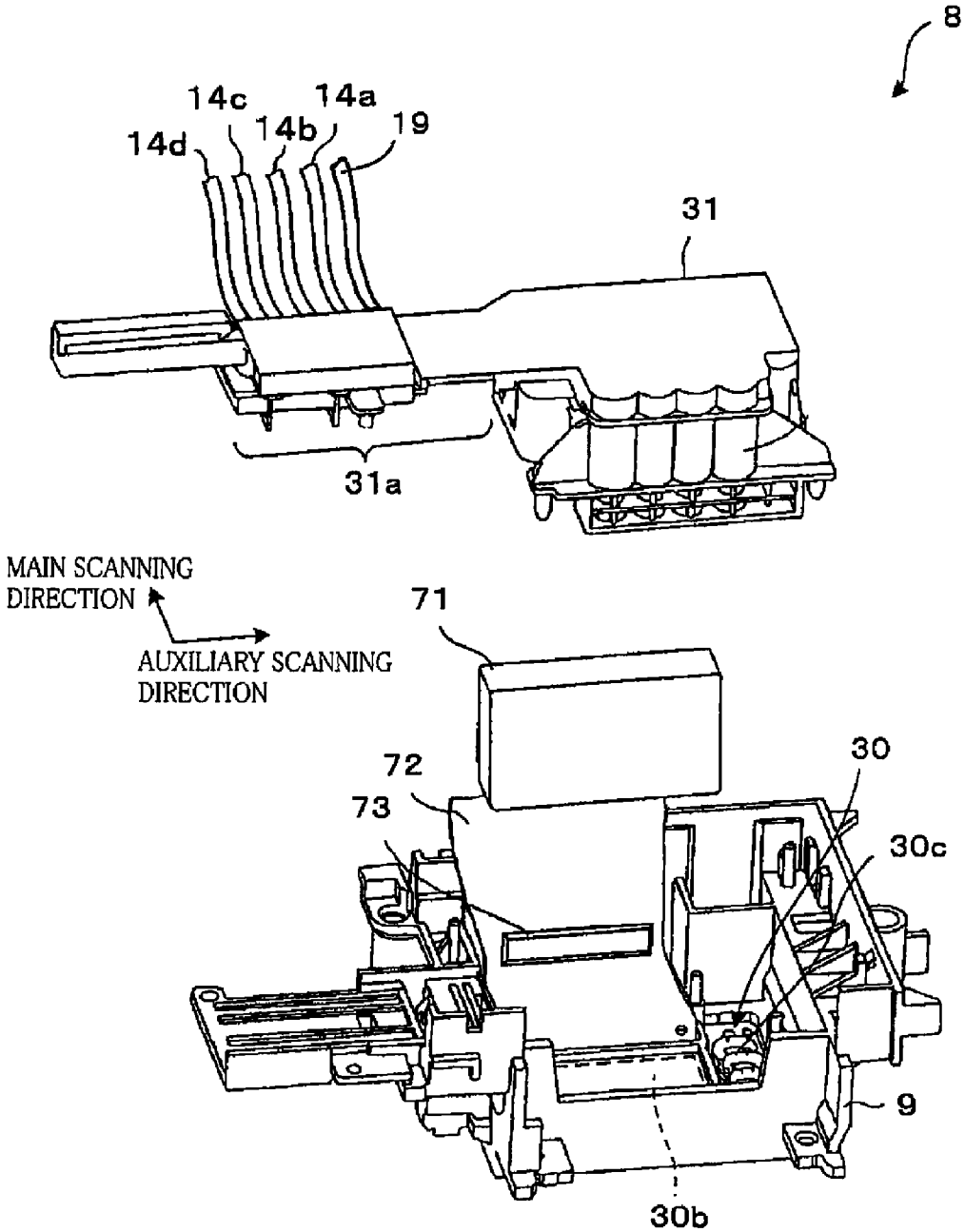
FIG. 4 is a perspective view showing an inkjet head shown in FIG. 1, in a state where a sub tank and others are removed from a carriage.
Figure 5:
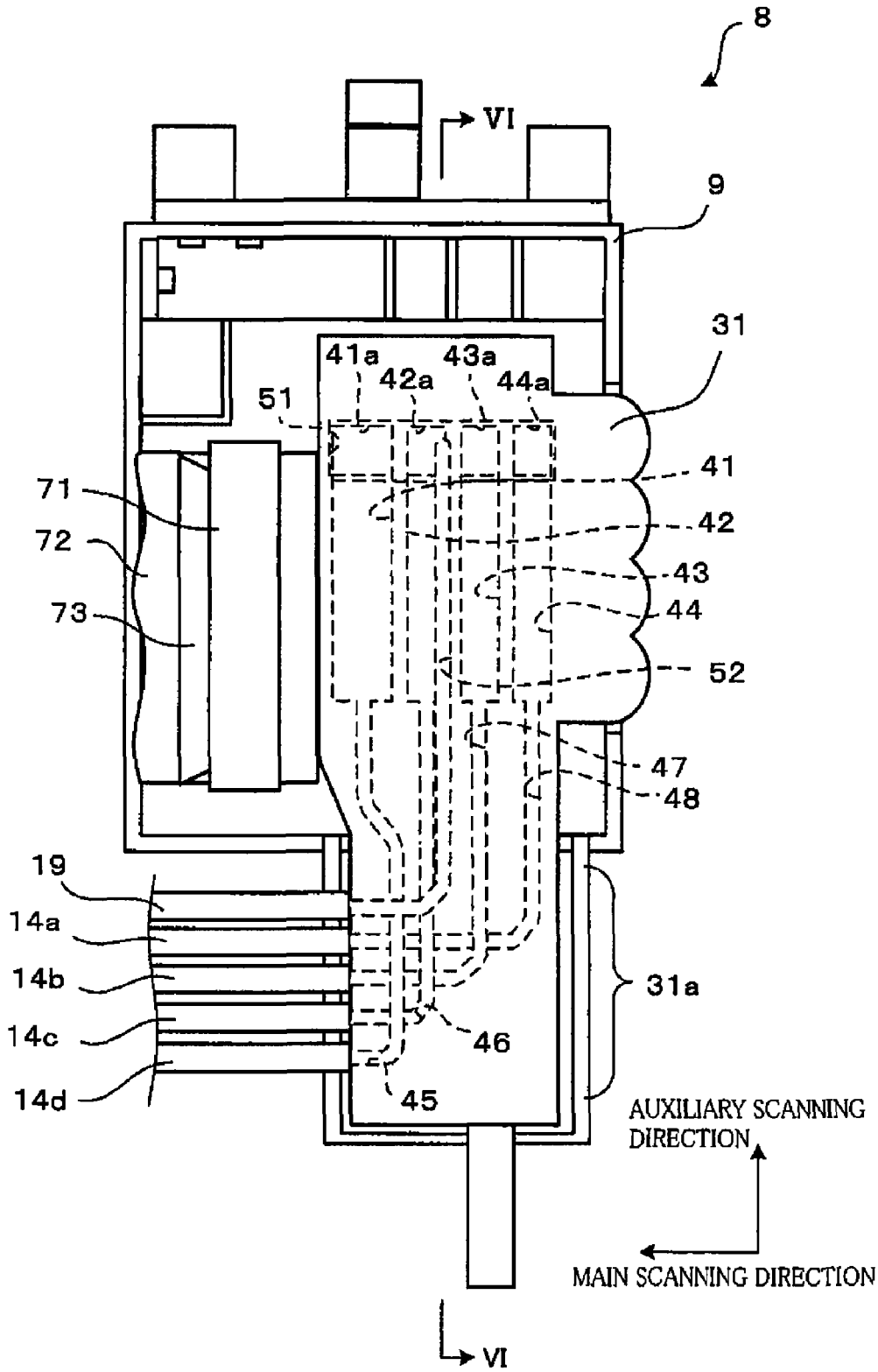
FIG. 5 is a plan view of the inkjet head where a head cover is removed.

Referring to FIGS. 4 and 5, the inkjet head 8 will be described in further detail. FIG. 4 is a perspective view of the inkjet head 8 where a head cover, the sub tank 31, and others are removed from the carriage 9. FIG. 5 is a plan view of the inkjet head 8 in a state where the head cover is removed. The carriage 9 generally has the shape of a rectangular parallelepiped or a box open on the upper side. The carriage 9 accommodates the sub tank 31 and the head mainbody 30, and the head cover (not shown in FIGS. 4 and 5) covers the carriage 9 from the upper side.

The sub tank 31 has an introducing portion 31*a* which the ink tubes 14*a*-14*d* and the air tube 19 are connected with. The head mainbody 30 is fixed on a bottom of the carriage 9. As shown in FIG. 4, on an upper surface of the head mainbody 30, four ports 30*c* are formed. The ports 30*c* function as inlets through which the four inks of different colors are respectively introduced. The sub tank 31, which has ink outlets for supplying the inks to the head mainbody 30 therethrough, is accommodated in the carriage 9 and above the head mainbody 30, such that the ink outlets are in communication with the ports 30*c*.

In the head mainbody 30, ink passages (not shown) are formed. One of two opposite ends of each ink passage communicates with one of the nozzles 30*a*, and the other end thereof communicates with one of the ports 30*c*. To the upper surface of the head mainbody 30, an ejection actuator 30*b* is attached, as shown in FIG. 4. The ejection actuator 30*b* selectively gives the inks, which fill the ink passages in the head mainbody 30, ejection energy so as to eject droplets of the inks from the nozzles 30*a* open in the lower surface of the head mainbody 30. For instance, the ejection actuator 30*b* is constituted by a piezoelectric layer and an electrode layer for generating an electric field at the piezoelectric layer in order to deform the piezoelectric layer. When a drive signal is supplied to the electrode layer, the piezoelectric layer deforms, causing a pressure variation in an ink in the ink passage so as to eject a droplet of the ink.

From the upper surface of the ejection actuator 30*b*, a flexible wiring board 72 extends upward, so as to be connected with the control unit 100, as shown in FIG. 4. The flexible wiring board 72 provides the electrode layer the drive signal for ejecting an ink droplet. The flexible wiring board 72 has wiring for transmitting an electrical signal. On the flexible wiring board 72, there is implemented a driver circuit board 73. The control unit 100 sends the driver circuit board 73 a control signal for the ink droplet ejection via the flexible wiring board 72, and upon receiving the control signal, the driver circuit board 73 converts the control signal into the drive signal which is sent to the ejection actuator 30*b*. The driver circuit board 73 extends vertically as well as along the auxiliary scanning direction, and has a shape long in the auxiliary scanning direction. A first surface of the driver circuit 73 which is opposed to the flexible wiring board 72 extends along a surface perpendicular to the main scanning direction. A second surface of the driver circuit 73 opposite to the first surface with respect to the auxiliary scanning direction also extends along the surface perpendicular to the main scanning direction.

In the carriage 9, there is disposed a heatsink 71 for preventing overheat of the driver circuit board 73. The heatsink 71 is formed of metal, and elongate in the auxiliary scanning direction, as shown in FIGS. 4 and 5. The heatsink 71 is disposed between the driver circuit board 73 and the sub tank 31 in the main scanning direction. A surface of the heatsink 71 opposed to the driver circuit board 73 extends along a surface of the driver circuit board 73 and is in close contact with the driver circuit board 73. To maintain the close contact between the heatsink 71 and the driver circuit board 73, the heatsink 71 is fixed to the driver circuit board 73 by being bonded thereto with an adhesive or others. Alternatively, the close contact may be maintained by an elastic member or others that applies a biasing force to the heatsink 71. With the heatsink 71 and the driver circuit board 73 thus held in close contact, heat generated at the driver circuit board 73 is transferred to the heatsink 71 with stability.

Figure 6:
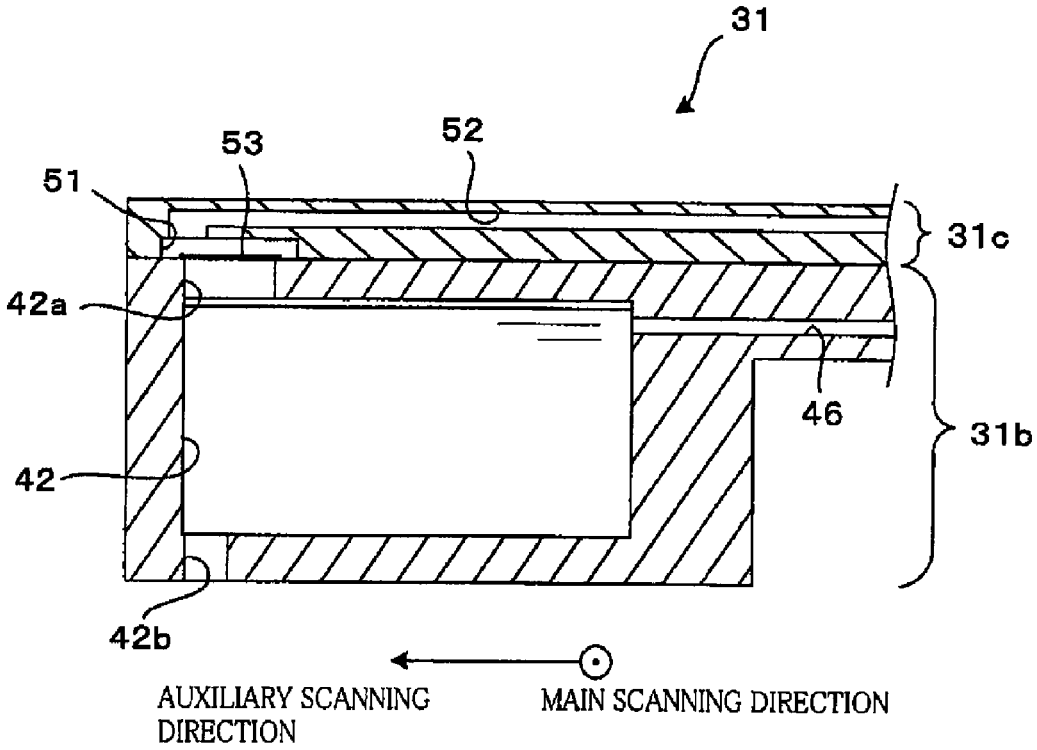
FIG. 6 is a vertical cross-sectional view of the sub tank taken along line VI-VI in FIG. 5.

There will be described an internal structure of the sub tank 31, with reference to FIGS. 5 and 6. In FIG. 5, the internal structure of the sub tank 31 is indicated by broken line. FIG. 6 is a vertical cross-sectional view of the sub tank 31 taken along line VI-VI in FIG. 5.

The sub tank 31 has a tank mainbody 31*b* and a lid member 31*c*, as shown in FIG. 6. In the tank mainbody 31*b* are formed ink storage chambers 41-44 in which the inks are respectively stored, as shown in FIG. 5. In the tank mainbody 31*b* are further formed ink passages 45-48 for introducing the inks from the ink tubes 14*a*-14*d* into the ink storage chambers 41-44. That is, the inks supplied from the main tanks 5*a*-5*d* through the ink tubes 14*a*-14*d* flow into the ink storage chambers 41-44 via the ink introduction passages 45-48. The ink storage chambers 41-44 store the inks of respective colors, i.e., Bk, C, M and Y. It is noted that although in FIG. 6 only one 42 of the ink storage chambers 41-44 is shown, the ink storage chambers 41-44 are common in structure, that is, have a structure shown in FIG. 6, unless otherwise specifically stated.

The ink storage chambers 41-44 substantially have the shape of a rectangular parallelepiped that is long in the auxiliary scanning direction, and are arranged along the main scanning direction. The ink storage chambers 42-44 have a same inner volume and the ink storage chamber 41 has an inner volume larger than that of the other ink storage chambers 42-44. This is because that the ink storage chamber 41 stores the ink of Bk, or the black ink, which is generally depleted sooner than the other inks, i.e., the inks of cyan (C), magenta (M), and yellow (Y), and thus the ink storage chamber 41 is required to be able to store a larger amount of ink than the other ink storage chambers 42-44 are.

In the tank mainbody 31*b* and above the ink storage chambers 41-44, there are formed communication holes 41*a*-44*a*. An upper surface of the tank mainbody 31*b* extends along a horizontal surface, and the communication holes 41*a*-44*a* open in the upper surface of the tank mainbody 31*b*. To the upper surface of the tank mainbody 31*b*, a gas-permeable film 53 is bonded with an adhesive or others such that the gas-permeable film 53 covers or closes opening ends of the communication holes 41*a*-44*a*. The gas-permeable film 53 allows gas to pass therethrough, but does not allow other materials, such as ink and solid material, to pass therethrough. For instance, the gas-permeable film 53 is formed of a porous fluororesin material.

In the tank mainbody 31*b*, and at bottoms of the ink storage chambers 41-44, there are formed ink outlet passages 41*b*-44*b* for therethrough supplying the inks to the head mainbody 30. The ink outlet passages 41*b*-44*b* are in communication with upper ends or inlet ends of the ports 30*c* open in the upper surface of the head mainbody 30. For facilitating comprehension, in FIG. 5 the ink outlet passages 41*b*-44*b* are not shown, and in FIG. 6 only one 42*b* of the ink outlet passages 41*b*-44*b* is shown.

In the lid member 31*c*, the air chamber 51 and an air passage 52 are formed. In plan view, the air chamber 51 has a rectangular shape long in the main scanning direction. More specifically, the air chamber 51 is a recessed portion in the lid member 31*c* that is open in a lower surface of the lid member 31*c*, and extends in the main scanning direction across the ink storage chambers 41-44. The air chamber 51 communicates with one of two opposite ends of the air passage 52. The other end of the air passage 52 communicates with the air tube 19.

Figure 7A:
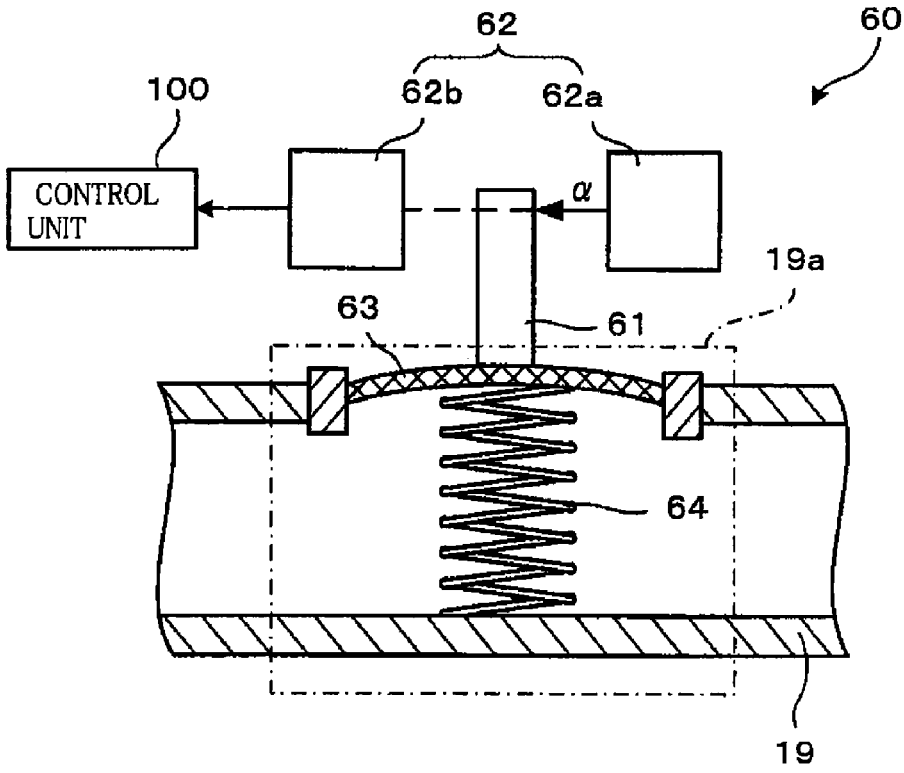
FIGS. 7A and 7B are views showing a pressure detecting device shown FIG. 1 and its vicinity.
Figure 7B:
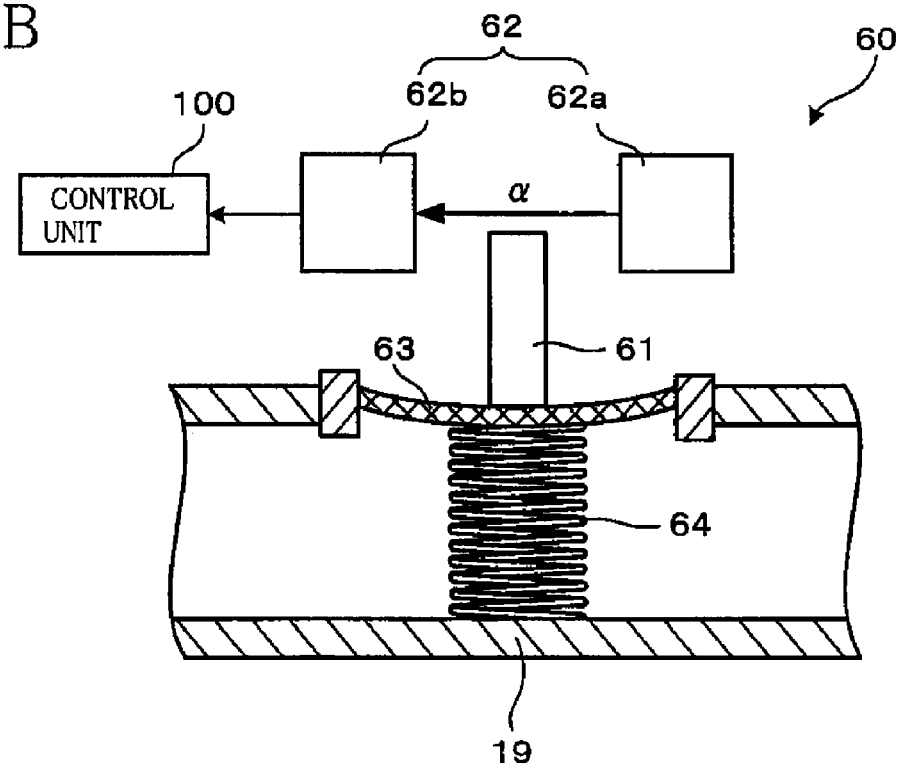

There will be described the pressure detecting device 60 with reference to FIGS. 7A and 7B. The air tube 19 includes a pressure detection portion 19*a* at which a part of a wall of the air tube 19 is flexible and expands and contracts in accordance with change in the internal pressure of the air tube 19. The pressure detecting device 60 includes an optical sensor 62 disposed on the outer side of the pressure detection portion 19*a* and a shield plate 61 as a form of a detected element of the invention. The optical sensor 62 has a light emitting portion 62*a* that emits light α, and a light receiving portion 62*b* including a light receiving element disposed on a line extended along a path of the emitted light α. The light receiving portion 62*b* outputs to the control unit 100 a signal indicative of an intensity of the light that the light receiving portion 62*b* receives.

The flexible part of the wall of the air tube 19 in the pressure detection portion 19*a* is opposed to the optical sensor 62 and formed of an elastic film 63 formed of an elastic material more easily deformable in correspondence with change in the internal pressure of the air tube 19 than a material forming the other part of the air tube 19. In place of the elastic film 63 formed of the elastic material, other flexible members such as a resin film may constitute the flexible part of the wall of the air tube 19 in the pressure detection portion 19*a*. In the pressure detection portion 19*a*, there is disposed a biasing member 64 that biases the elastic film 63 toward the optical sensor 62. Hence, the elastic film 63 is deformed to protrude toward the optical sensor 62, as shown in FIG. 7A, when the internal pressure of the air tube 19 is equal to or higher than a first predetermined threshold. As the internal pressure of the air tube 19 decreases from the state of FIG. 7A, the elastic film 63 inwardly deforms against the biasing force of the biasing member 64 due to a difference between the external and internal pressures of the air tube 19.

To an outer surface of the elastic film 63, the shield plate 61 is fixed. The position at which the shield plate 61 is fixed is such that as the elastic film 63 deforms as described above, the shield plate 61 moves from a first position (shown in FIG. 7A) that corresponds to a detection position on the path of the light α to block the light α, to a second position (shown in FIG. 7B) apart from the first position. Further, the biasing force of the biasing member 64 is set such that when the internal pressure of the air tube 19 is equal to or higher than the first threshold, the shield plate 61 blocks the light α, and when the internal pressure of the air tube 19 is lower than the first threshold, the shield plate 61 is off the path of the light α. Thus, the control unit 100 can determine whether the shield plate 61 is located on the path of the light α or not, on the basis of the intensity of the received light, of which the signal from the light receiving portion 62*b* is indicative. Based on a result of this determination, the control unit 100 can determine whether the internal pressure of the air tube 19 is lower than the first threshold. In this way, the pressure detecting device 60 can detect whether the internal pressure of the air tube 19 is lower than the threshold or not. It is noted that the biasing member 64 may be omitted as long as the flexibility of the elastic film 63 is sufficiently high and the elastic film 63 is of a film deformable in accordance with change in the internal pressure of the air tube 19.

Figure 8A:
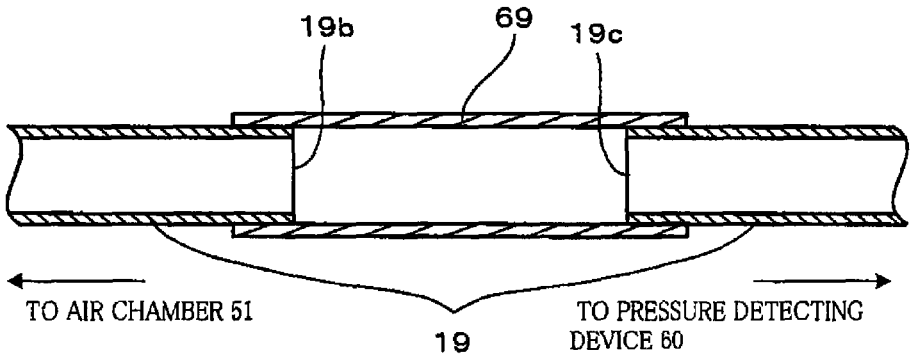
FIGS. 8A and 8B are horizontal cross-sectional views of a pressure limiter shown in FIG. 1.
Figure 8B:
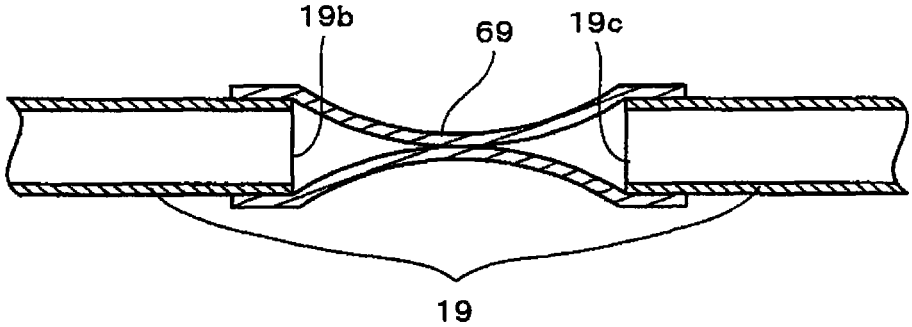

However, when the internal pressure of the air tube 19 decreases far below the first threshold and an internal pressure of the air chamber 51 accordingly decreases considerably, an excessive load may be imposed on the gas-permeable film 53. According to this embodiment, the pressure limiter 69 is disposed in order to prevent such an excessive load imposed on the gas-permeable film 53. As shown in FIG. 8A, the pressure limiter 69 is a tubular member having a size enabling fitting of the air tube 19 therein. In one of two opposite ends of the pressure limiter 69, a first open end portion 19*b* of the air tube 19 on the side of the air chamber 51 is fitted. In the other end of the pressure limiter 69, a second open end portion 19*c* of the air tube 19 on the side of the pressure detecting device 60 is fitted. When the internal pressure of the air tube 19 decreases below the first threshold, the pressure limiter 69 deforms in accordance with a difference between the external and internal pressures of the pressure limiter 69, such that the pressure limiter 69 becomes thinner or a wall of the pressure limiter 69 is drawn inward. It is adjusted such that when the internal pressure of the air tube 19 decreases to a second predetermined threshold, an internal space of the pressure limiter 69 is completely closed as shown in FIG. 8B, in order to prevent an excessive decrease in the internal pressure of the air tube 19.

There will be described in further detail control implemented by the control unit 100. The suction controlling portion 102 of the control unit 100 implements an air-chamber suction processing for having the suction pump 81 suck the air chamber 51. This air-chamber suction processing will be described. When these tubes 16, 18 are not communicated with each other, the suction control portion 102 initially controls the flow-path switching device 82 to establish a communication between the air tubes 16 and 18. By this, the suction pump 81 and the air chamber 51 are communicated with each other, via the air tubes 16, 18, the charge tank 84, the air tube 19, and the air passage 52. The air passage 52 cooperates with the air tubes 18, 19 and the charge tank 84 to constitute a first suction passage of the invention. Then, the suction pump 81 is operated to suck the air from the air chamber 51 until it is determined on the basis of the result of the detection by the pressure detecting device 60 that the internal pressure of the air tube 19 is lower than the first threshold, that is, that the internal pressure of the air chamber 51 is lower than the first threshold.

At a point in the air tube 18, the check valve 83 is disposed as described above, and the air flow in the air tube 18 is limited to a direction from the charge tank 84 to the flow-path switching device 82. Hence, when the air-chamber suction processing is terminated such that the operation of the suction pump 81 is stopped or such that the flow path is switched by operating the flow-path switching device 82, after the internal pressure of the air chamber 51 (i.e., the internal pressure of the air tube 19 or the charge tank 84) has decreased below the first threshold, the valve element 83*a* is placed at the closing position to disconnect the communication between the first and second valve chambers 83*b* and 83*c* due to the difference in the internal pressures of these valve chambers 83*b*, 83*c*. Thus, air flow into the air chamber 51 is inhibited, thereby enabling to hold the internal pressure of the air chamber 51 below the first threshold.

Since the air chamber 51 and the ink storage chambers 41-44 are defined on the opposite sides of the gas-permeable film 53, the air in the ink storage chambers 41-44 can be separated from the inks (i.e., the gas-liquid separation is implemented) and sucked into the air chamber 51 through the gas-permeable film 53, by the internal pressure of the air chamber 51 held below the first threshold. Thus, in the present embodiment, the air in the ink storage chambers 41-44 is sucked by implementation of the air-chamber suction processing for sucking the air from the air chamber 51. That is, in the air-chamber suction processing, the air is sucked from the ink supply passage, which is a form of the liquid supply passage of the invention and extends from the main tanks 5*a*-5*d* to the head mainbody 30 via the ink storage chambers 41-44. By implementing the air-chamber suction processing, a passage suction processing of the invention is implemented. The above-described first threshold is set such that a sufficient degree of gas-liquid separation between the air and the inks can be achieved by the sucking of the air from the ink storage chambers 41-44 through the gas-permeable film 53. For instance, the first threshold is set at a value lower than the atmospheric pressure. Thus, holding the internal pressure of the air chamber 51 below the first threshold, the gas-liquid separation in the ink storage chambers 41-44 is maintained, thereby inhibiting the air flow from the ink storage chambers 41-44 into the head mainbody 30.

On the basis of the result of the detection by the pressure detecting device 60, the control unit 100 can determine whether the internal pressure of the air chamber 51 is below the first threshold or not. Hence, it is possible to implement a control such that the control unit 100 operates to have the suction pump 81 suck the air chamber 51 until the internal pressure of the air chamber 51 decreases below the first threshold, which is detected by the pressure detecting device 60.

On the basis of the result of the detection by the pressure detecting device 60, the control unit 100 implements various other control processings, too. There will be described these control processings.

Figure 9:
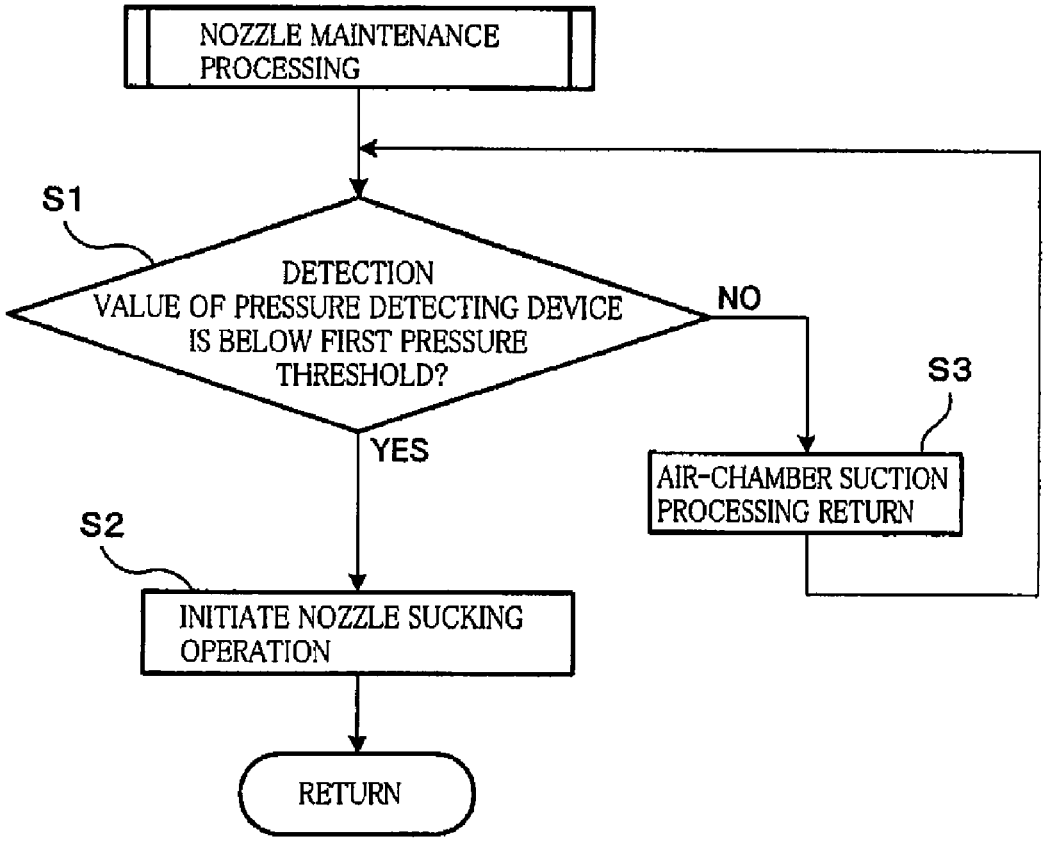
FIG. 9 is a flowchart illustrating a nozzle maintenance processing implemented by a control unit of the inkjet printer.

A first one of the other control processings is a nozzle maintenance processing that is illustrated in the form of a flowchart in FIG. 9. The processing flow starts with step S1 in which the control unit 100 determines, on the basis of the intensity of the light $\alpha$ which the signal from the light receiving portion 62*b* of the pressure detecting device 60 is indicative of, whether the internal pressure of the air tube 19 is below the first threshold. When the control unit 100 determines that the internal pressure of the air tube 19 is not below the threshold, a negative decision (NO) is made in step S1 and the processing flow goes to step S3 in which the suction control portion 102 of the control unit 100 implements the air-chamber suction processing. Until the internal pressure of the air tube 19 decreases below the first threshold, steps S1 and S3 are repeatedly implemented, in other words, the air-chamber suction processing is continued.

When the control unit 100 determines in step S1 that the internal pressure of the air tube 19 is below the threshold, an affirmative decision (YES) is made and the processing flow goes to step S2 in which the suction control portion 102 initiates a nozzle sucking operation. The nozzle sucking operation is implemented as follows. First, the suction control portion 102 controls the flow-path switching device 82 to communicate the air tube 16 with the air tube 17*a*. With the communication between the air tubes 16 and 17*a* established, the suction pump 81 and an internal space of one 21*b* of the protrusions of the suction cap 21 are in communication with each other via the air tubes 17*a* and the corresponding one of the suction openings 21*a*. An air passage constituted by the air tubes 17*a* and the suction opening 21*a* corresponds to a second suction passage of the invention.

Then, the suction control portion 102 operates to move the carriage 9 to the maintenance position over the capping device 20, and control the capping device 20 to move the suction cap 21 to the covering position to seal the nozzles 30*a*. After the nozzles 30*a* are thus covered by the suction cap 21, the suction control portion 102 controls the suction pump 81 to suck the internal space of the protrusion 21*b* of the suction cap 21. Thereafter, the suction control portion 102 controls the flow-path switching device 82 to communicate the air tubes 16, 17*b* with each other, and have the suction pump 81 suck from the internal space of the other 21*c* of the two protrusions 21*b*, 21*c* of the suction cap 21. Then, the nozzles 30*a* that are surrounded by the protrusion 21*c* in plan view are this time subjected to sucking by the suction pump 81. By implementation of the nozzle sucking operation, waste ink on the lower surface of the head mainbody 30 around the nozzles 30*a*, and air having been introduced in the ink passages, are eliminated. According to the nozzle sucking operation, the nozzles 30*a* surrounded or covered by the protrusion 21*b* and the nozzles 30*a* surrounded or covered by the protrusion 21*c* can be subjected to the suction by the suction pump 81 independently of each other.

As described above, according to the nozzle maintenance processing, the air-chamber suction processing is implemented when it is determined on the basis of the result of the detection by the pressure detecting device 60 that the internal pressure of the air chamber 51 (or of the air tube 19) is equal to or higher than the first threshold, and the suction of the air chamber 51 (i.e., the air-chamber suction processing) is continuously implemented until the internal pressure of the air chamber 51 decreases below the first threshold. When the internal pressure of the air chamber 51 has decreased below the first threshold, the nozzle sucking operation is initiated. Hence, it is inhibited that the nozzle sucking operation is initiated before the internal pressure of the air chamber 51 decreases below the first threshold. That is, it is inhibited that the nozzle sucking operation is implemented before the gas-liquid separation in the ink storage chambers 41-44 is not achieved to a sufficient degree, which would otherwise undesirably cause inflow of the air into the head mainbody 30 from the ink storage chambers 41-44. When an amount of suction during the nozzle sucking operation is relatively small, air bubbles in the ink passages may not be sufficiently eliminated by the nozzle sucking operation. However, according to this embodiment the air-chamber suction processing is implemented prior to the nozzle sucking operation such that the nozzle sucking operation is implemented only after the internal pressure of the air chamber 51 becomes lower than the first threshold, as described above, and thus the nozzle sucking operation is implemented after the air is eliminated or separated from the inks in the ink storage chambers 41-44, thereby reducing an amount of the air flowing into the head mainbody 30 from the ink storage chambers 41-44. Hence, air bubbles are inhibited from remaining in the ink passages, even in a case where the amount of suction in the nozzle sucking operation is relatively small. In this embodiment, a portion of the control unit 100 that implements step S1 constitutes an ejection-opening suction permitting portion.

Figure 10:
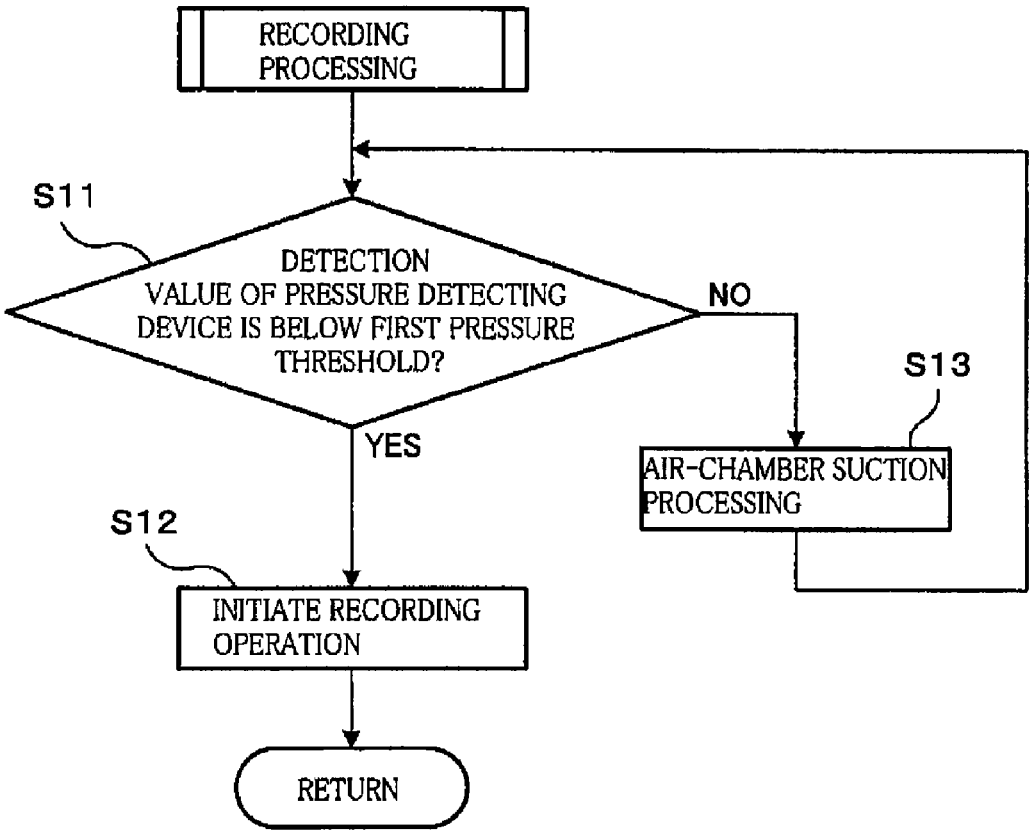
FIG. 10 is a flowchart illustrating a recording processing implemented by the control unit.

A second one of the other control processings implemented based on the result of the detection by the pressure detecting device 60 is a recording processing, which is illustrated in FIG. 10 in the form of a flowchart. The recording processing is initiated with step S11 in which the control unit 100 determines, on the basis of the intensity of the light that the signal from the light receiving portion 62*b* of the pressure detecting device 60 is indicative of, whether the internal pressure of the air tube 19 is below the first threshold. When it is determined that the internal pressure of the air tube 19 is not below the first threshold, a negative decision (NO) is made in step S11 and the processing flow goes to step S13 in which the suction control portion 102 of the control unit 100 implements the air-chamber suction processing. Thereafter, until the internal pressure of the air tube 19 decreases below the first threshold, steps S11 and S13 are repeatedly implemented, in other words, the air-chamber suction processing is continued. When it is determined that the internal pressure of the air tube 19 has decreased below the first threshold, an affirmative decision (YES) is made in step S11 and the processing flow goes to step S12 in which the recording control portion 101 of the control unit 100 initiates a recording operation.

As described above, in the recording processing, the air-chamber suction processing is implemented when it is determined on the basis of the result of the detection by the pressure detecting device 60 that the internal pressure of the air chamber 51 (or of the air tube 19) is equal to or higher than the threshold, and the sucking the air from the air chamber 51 (i.e., the air-chamber suction processing) is continued until the internal pressure of the air chamber 51 decreases below the first threshold. When the internal pressure of the air chamber 51 has decreased below the first threshold, the recording operation is initiated. Hence, it is inhibited that the recording operation is initiated before the internal pressure of the air chamber 51 decreases below the first threshold. This in turn inhibits air flow from the ink storage chambers 41-44 into the head mainbody 30 due to a recording operation implemented while the gas-liquid separation in the ink storage chambers 41-44 is not achieved in a sufficient degree. In this embodiment, a portion of the control unit 100 that implements step S11 constitutes a recording permitting portion.

The sucking the air from the air chamber 51 by the suction pump 81 may be continued even after initiation of the recording operation, or may be terminated when the recording operation is initiated. Even when the sucking is terminated when the recording operation is initiated, the check valve 83 operates to hold the internal pressure of the air chamber 51 below the first threshold, as described above. After initiation of the recording operation, droplets of the inks are ejected from the nozzles 30*a*, and a portion of the inks in the main tanks 5*a*-5*d* moves or flows into the ink storage chambers 41-44 to replenish the ink storage chambers 41-44. At this time, the air included in the inks stored in the main tanks 5*a*-5*d* may also move or flow into the ink storage chambers 41-44 with the inks. However, according to the embodiment where the internal pressure of the air chamber 51 is held under the first threshold, the air thus introduced into the ink storage chambers 41-44 is separated from the inks in the ink storage chambers 41-44.

Figure 11:
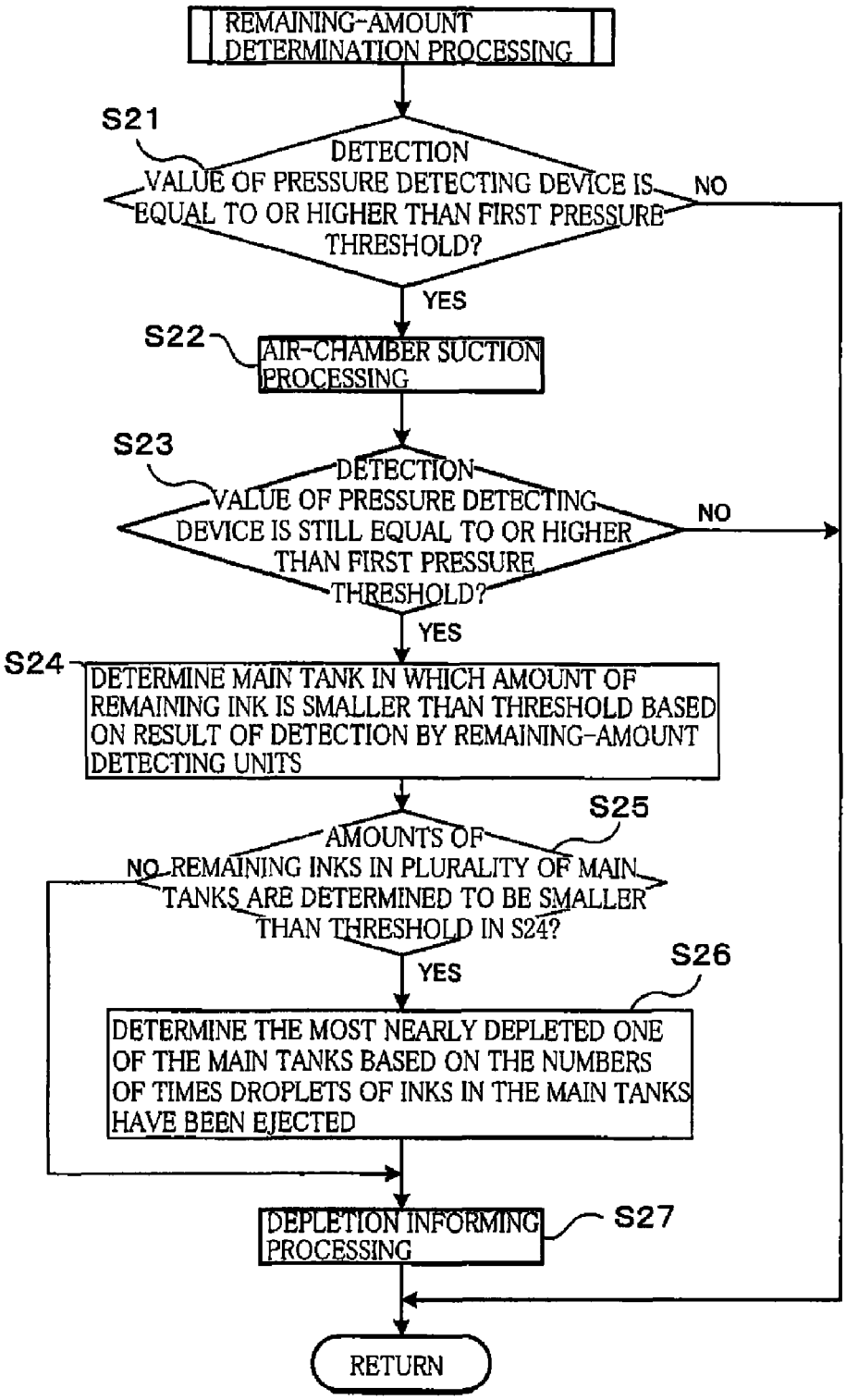
FIG. 11 is a flowchart illustrating a remaining-amount determination processing implemented by the control unit.

A third one of the other control processings implemented based on the result of the detection by the pressure detecting device 60 is a remaining-amount determination processing. Normally, once the internal pressure of the air chamber 51 is decreased below the first threshold by the air-chamber suction processing, the internal pressure of the air chamber 51 is held under the first threshold by the operation of the check valve 83. When the internal pressure of the air chamber 51 does not decrease but remains equal to or higher than the first threshold even after the air-chamber suction processing is initiated, it is assumed that the ink in at least one of the main tanks 5*a*-5*d* is depleted and the air in the depleted tank 5*a*-5*d* flows into the air chamber 51 via the corresponding ink storage chamber 41-44. Based on this phenomenon, the remaining-amount determining portion 103 of the control unit 100 implements the remaining-amount determination processing for identifying a main tank 5*a*-5*d* that is depleted. FIG. 11 is a flowchart illustrating the remaining-amount determination processing.

The remaining-amount determination processing starts with step S21 in which the control unit 100 determines on the basis of the result of the detection by the pressure detecting device 60 whether the internal pressure of the air chamber 51 (or of the air tube 19) is equal to or higher than the first threshold. When it is determined that the internal pressure is neither equal to nor higher than the threshold, a negative decision (NO) is made in step S21 and the remaining-amount determining portion 103 of the control unit 100 determines that no main tanks 5*a*-5*d* are depleted and the remaining-amount determination processing of this cycle is terminated. On the other hand, when the internal pressure of the air chamber 51 is equal to or higher than the threshold and an affirmative decision (YES) is made in step S21, the processing flow goes to step S22 in which the suction control portion 102 of the control unit 100 implements the air-chamber suction processing. Thereafter, the processing flow goes to step S23 in which the remaining-amount determining portion 103 again determines on the basis of the result of the detection by the pressure detecting device 60 whether the internal pressure of the air chamber 51 is still equal to or higher than the threshold. When it is determined that the internal pressure of the air chamber 51 is restored to a level below the first threshold and a negative decision (NO) is made in step S23, it is determined that no main tanks 5*a*-5*d* are depleted and the remaining-amount determination processing of this cycle is terminated.

On the other hand, when it is determined that the internal pressure of the air chamber 51 is still equal to or higher than the threshold and an affirmative decision (YES) is made in step S23, the remaining-amount determining portion 103 determines that at least one of the main tanks 5*a*-5*d* is depleted. Then, the processing flow goes to step S24 in which the remaining-amount determining portion 103 determines, on the basis of the result of the detection by the remaining-amount detecting devices 6*a*-6*d*, in which main tank 5*a*-5*d* the amount of the remaining ink becomes smaller than the threshold that is set at a value near zero. More specifically, when at least one of the main tanks 5*a*-5*d* is depleted, the result of the detection by the remaining-amount detecting device 6*a*-6*d* corresponding to the depleted main tank 5*a*-5*d* shall indicate that the amount of the remaining ink is below the threshold near zero. Hence, when the result of the detection by the remaining-amount detecting device 6*a*-6*d* corresponding to any one of the main tanks 5*a*-5*d* indicates that the amount of the remaining ink in the one main tank is below the threshold near zero, the remaining-amount determining portion 103 determines that the one main tank is depleted.

Then, the processing flow goes to step S25 in which the remaining-amount determining portion 103 determines whether there are a plurality of the main tanks 5*a*-5*d* the amounts of the remaining inks in which are determined to be smaller than the threshold in step S24. When the amount of the remaining ink in only a single main tank 5*a*-5*d* is determined to be smaller than the threshold in step S24, a negative decision (NO) is made in step S25 and the processing flow goes to step S27. On the other hand, when the amounts of the remaining inks in a plurality of the main tanks 5*a*-5*d* are determined to be smaller than the threshold in step S24, an affirmative decision (YES) is made in step S25 and the processing flow goes to step S26, in which the remaining-amount determining portion 103 refers to, with respect the main tanks 5*a*-5*d* in which the amounts of the remaining inks are determined to be smaller than the threshold in step S24, estimated ink amounts having been consumed since the remaining-amount detecting devices 6*a*-6*d* first indicated that the amounts of the remaining inks were below the threshold, that is, that the main tanks 5*a*-5*d* in question were nearly depleted. That is, in this embodiment, the numbers of times ink droplets have been ejected from the nozzles 30*a* corresponding to the respective main tanks 5*a*-5*d* in question are counted. The counts are used as values indicative of the estimated ink amounts consumed, based on which the one among the main tanks 5*a*-5*d* in question that is most likely depleted is determined. The main tank thus determined to be most likely depleted is determined to be the depleted one of the main tanks 5*a*-5*d*. Then, the processing flow goes to step S27 to implement a depletion informing processing for informing a user of the depletion of the main tank 5*a*-5*d* thus determined. The depletion informing processing is implemented for instance such that a character string or others indicating the determined main tank is presented on the display device.

There will be described an operation and effects of the present embodiment.

According to this embodiment, due to the operation of the check valve 83 as described above, the air is held separated from the inks in the ink storage chambers 41-44 even after sucking the air from the air chamber 51 is terminated. Hence, even where a recording operation or a nozzle sucking operation is initiated thereafter, air flow from the ink storage chambers 41-44 into the head mainbody 30 is inhibited.

Since the various control processings are implemented on the basis of the result of the detection by the pressure detecting device 60, it is enabled to implement the control to continuously suck the air from the air chamber 51 until the internal pressure thereof becomes lower than the first threshold, and a control to initiate a recording operation and a nozzle sucking operation when the internal pressure of the air chamber 51 has decreased below the first threshold.

In the remaining-amount determination processing, where it is determined that the result of the detection by the pressure detecting device 60 indicates that the internal pressure is equal to or higher than the threshold, the same determination is repeatedly made after implementation of the air-chamber suction processing, and only when it is determined that the detection result indicates that the internal pressure is still equal to or higher than the threshold, it is determined that at least one of the main tanks 5*a*-5*d* is depleted. Thus, in a case where air flow into the air chamber 51 merely temporarily occurs due to a cause other than depletion of at least one of the main tanks 5*a*-5*d*, an erroneous determination that at least one of the main tanks 5*a*-5*d* is depleted is not made. That is, it is determined with high accuracy that at least one main tank becomes depleted.

In the remaining-amount determination processing, after the determination of whether at least one of the main tanks 5*a*-5*d* is depleted is made based on the result of the detection by the pressure detecting device 60, a more specific determination, namely, a determination of whether there are a plurality of main tanks 5*a*-5*d* depleted or at least nearly depleted, is made on the basis of the result of the detection by the remaining-amount detecting device 6*a*-6*d*. When an affirmative decision is made in the latter determination, that is, when it is determined that a plurality of main tanks 5*a*-5*d* are depleted or at least nearly depleted, the one estimated to be most likely depleted among the main tanks 5*a*-5*d* determined to be depleted or at least nearly depleted is determined, on the basis of the numbers of times of ink droplet ejection. Thus, the depleted main tank can be determined with high precision and accuracy.

Between the air chamber 51 and the check valve 83, there is disposed and connected the charge tank 84, which has a cross-sectional area larger than those of the air tubes 18 and 19. Hence, as compared to a case where the air chamber 51 and the check valve 83 are connected with each other through an air tube only, an inner volume of an air passage between the air chamber 51 and the check valve 83 is increased. This means that an inner volume for accumulating pressure is increased, which is effective to prevent that the internal pressure of the air chamber 51 too frequently becomes equal to or higher than the first threshold, that is, that the internal pressure of the air chamber 51 becomes equal to or higher than the threshold even when only a slight amount of air is introduced into the air chamber 51. Therefore, it is enabled to prolong a period of time during which the ink storage chambers 41-44 can be held in the state where the air is separated from the inks, or the gas-liquid separation is achieved.

At a point in the air tube 19 is disposed the pressure limiter 69 which closes an internal space of the air tube 19 when the internal pressure of the air tube 19 excessively decreases. Therefore, even when the internal pressure of the air chamber 51 decreases far below the first threshold during the air-chamber suction processing, the pressure limiter 69 closes the internal space of the air tube 19 in order to prevent the internal pressure of the air chamber 51 from excessively decreasing.

Referring to FIGS. 12-20, there will be described inkjet printers according to other embodiments of the invention. In the following description of the other embodiments, parts or elements corresponding to those of the first or other embodiments described previously will be denoted by the same reference numerals as used in the first or previously described embodiments and description thereof is dispensed with.

Figure 12:
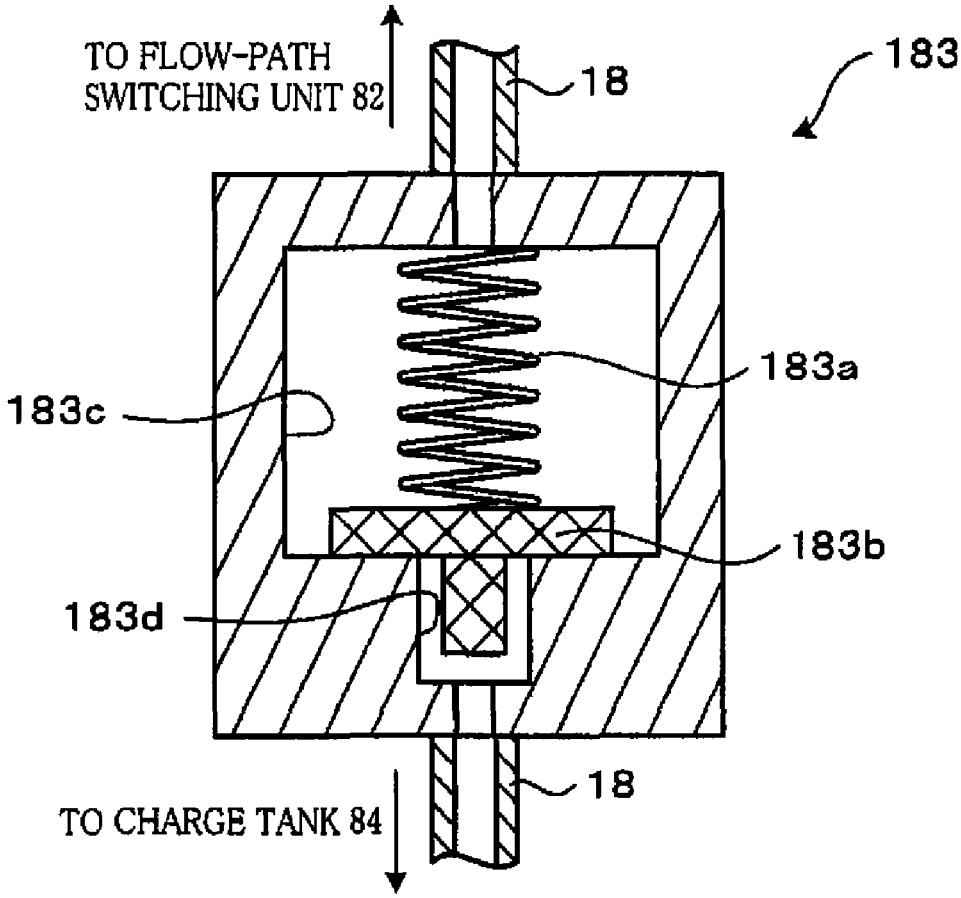
FIG. 12 is a cross-sectional view of a check valve in an inkjet printer according to a second embodiment.

Referring to FIG. 12, there will be described an inkjet printer according to a second embodiment of the invention, which differs from the first embodiment in the check valve. More specifically, in the second embodiment, a check valve 183 is employed in place of the check valve 83. As shown in FIG. 12, which is a cross-sectional view of the check valve 183, a first valve chamber 183*c* and a second valve chamber 183*d* are formed in the check valve 183. The first valve chamber 183*c* is communicated with an air tube 18 on the side of a flow-path switching device 82, and the second valve chamber 183*d* is communicated with the air tube 18 on the side of the charge tank 84. In the first and second valve chambers 183*c* and 183*d*, a valve element 183*b* is accommodated. The valve element 183*b* is movable between a closing position to close a communication portion between the first and second valve chambers 183*c*, 183*d* for disconnecting communication therebetween, and an opening position to open the communication portion for allowing the communication. In the first valve chamber 183*c* is disposed a biasing member 183*a* which biases the valve element 183*b* to the closing position. Therefore, while a suction pump 81 does not suck the air from the air tube 18, the valve element 183*b* is held at the closing position to close the communication portion between the first and second valve chambers 183*c*, 183*d*. On the other hand, when the suction pump 81 sucks the air from the air tube 18, an internal pressure of the first valve chamber 183*c* decreases and a sucking force acting from the first valve chamber 183*c* overcomes a resultant of a biasing force of the biasing member 183*a* and a sucking force acting from the second valve chamber 183*d*, thereby placing the valve element 183*b* at the opening position to open the communication portion between the first and second valve chambers 183*c*, 183*d*. When the suction pump 81 stops sucking the air from the air tube 18, the sucking force acting from the first valve chamber 183*c* decreases and the valve element 183*b* is moved to the closing position by the resultant of the biasing force of the biasing member 183*a* and the sucking force acting from the second valve chamber 183*d*. Thus, like the check valve 83 in the first embodiment, the check valve 183 can limit air flow in the air tube 18 in a direction from the charge tank 84 to the flow-path switching device 82.

Figure 13A:
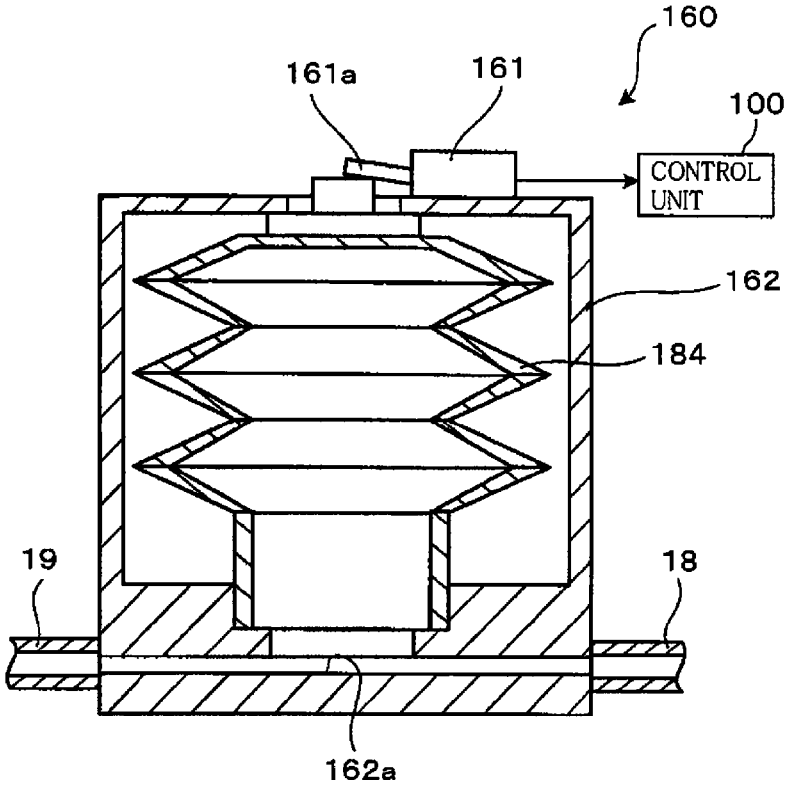
FIGS. 13A and 13B are views of a pressure detecting device in an inkjet printer according to a third embodiment.
Figure 13B:
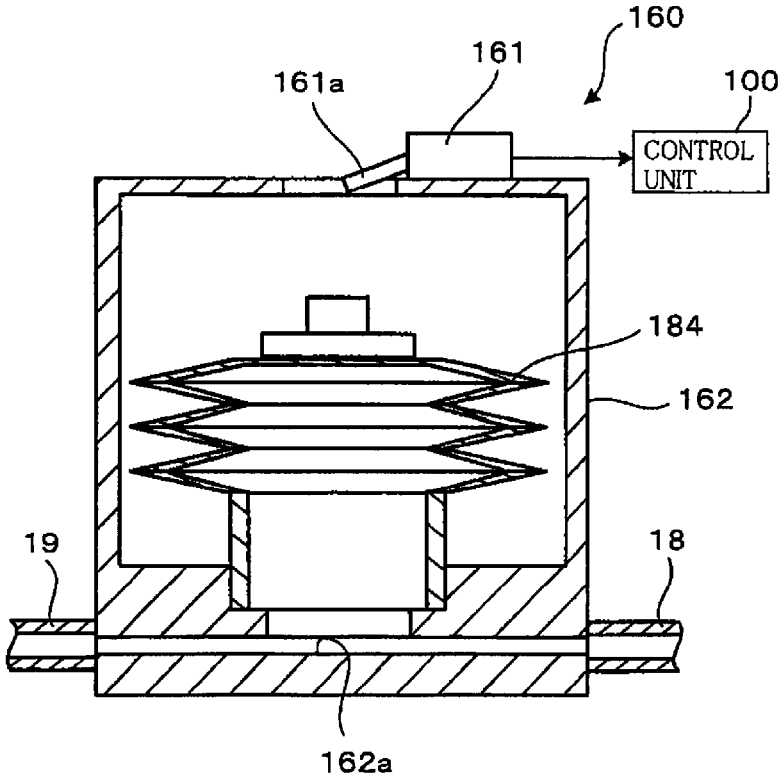

By referring to FIGS. 13A and 13B, there will be described an inkjet printer according to a third embodiment, which differs from the first embodiment in the pressure detecting device. That is, in the third embodiment, a pressure detecting device 160 is employed in place of the pressure detecting device 60. FIGS. 13A and 13B are cross-sectional views of the pressure detecting device 160. In the third embodiment, the pressure detecting device 160 is disposed along with a bellows tank 184 which is employed in place of the charge tank 84 in the first embodiment. The pressure detecting device 160 includes a detection tank 162 and the bellows tank 184 disposed in the detection tank 162. The bellows tank 184 has the shape of a bellows, and is vertically movable or deformable in accordance with an internal pressure thereof and fixed on a bottom surface of the detection tank 162. In the detection tank 162 is formed an air passage 162*a* which is communicated with air tubes 18, 19 and an internal space of the bellows tank 184.

The detection tank 162 is open upward, and a switch device 161 is fixed on an upper surface of the detection tank 162. The switch device 161 includes a switch lever 161*a*, which is switchable between a first state shown in FIG. 13A and a second state shown in FIG. 13B. In the first state, the switch lever 161*a* is inclined with a distal end thereof located on the upper side. In the second state, the switch lever 161*a* is inclined with the distal end located on the lower side. The switch device 161 has a means for biasing the switch lever 161*a* in a direction to place the switch lever 161*a* in the second state. The switch device 161 sends a control unit 100 a detection signal indicative of which of the first and second states the switch lever 161*a* is in.

When the internal pressure of the bellows tank 84 is equal to or higher than a threshold, an upper end of the bellows tank 184 is in contact with the switch lever 161*a*, as shown in FIG. 13A, thereby holding the switch lever 161*a* in the first state. As the internal pressure of the bellows tank 184 decreases, the bellows tank 84 downward contracts, and when the internal pressure becomes lower than the threshold, the upper end of the bellows tank 84 separates from the switch lever 161*a*, thereby placing the switch lever 161*a* in the second state.

According to this embodiment, the control unit 100 can determine whether the switch lever 161*a* is in the second state on the basis of the detection signal from the pressure detecting device 160, and in turn can determine whether the internal pressure of the bellows tank 184 is below the threshold or not. Since the bellows tank 184 can expand and contract, the bellows tank 184 can accumulate pressure therein.

Figure 14B:
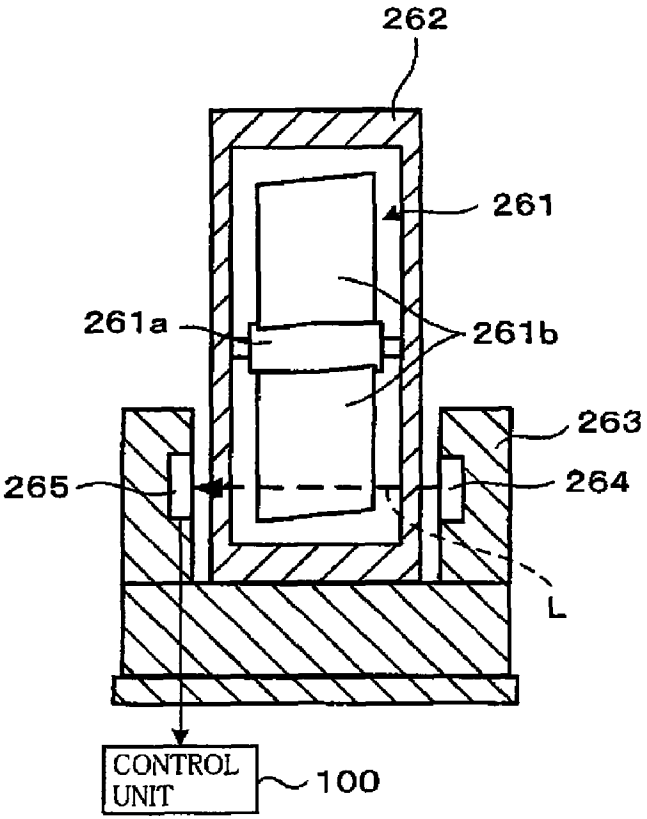
FIGS. 14A and 14B are views of a pressure detecting device in an inkjet printer according to a fourth embodiment.
Figure 14A:
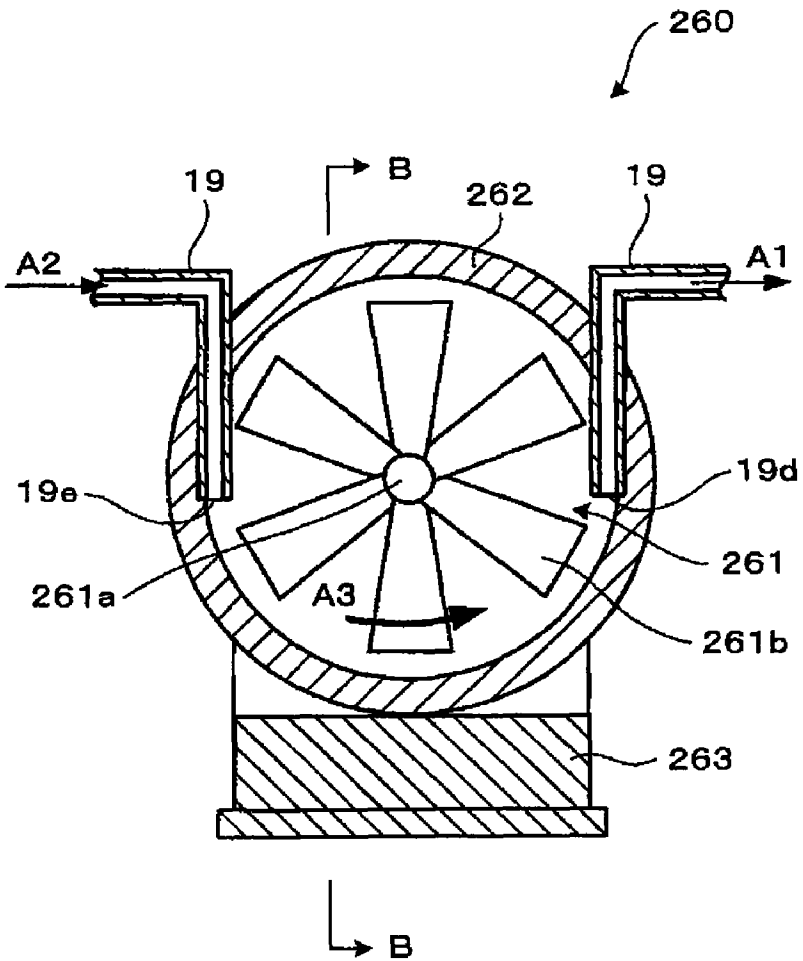

By referring to FIGS. 14A and 14B, there will be described an inkjet printer according to a fourth embodiment, which differs from the first embodiment in the pressure detecting device. More specifically, a pressure detecting device 260 is employed in the fourth embodiment in place of the pressure detecting device 60. FIG. 14A is a vertical cross-sectional view of the pressure detecting device 260, and FIG. 14B is a cross-sectional view taken along line B-B in FIG. 14A.

The pressure detecting device 260 includes a detection tank 262 disposed in an air tube 19. The detection tank 262 is supported by a support 263. In the detection tank 262, open ends 19*d*, 19*e* of the air tube 19 are inserted. Inside the detection tank 262 is disposed a vane wheel 261 having a shaft 261*a* and a plurality of vanes 261*b* arranged and fixed around the shaft 261*a*. The shaft 261*a* is supported in the detection tank 262 to be rotatable in a direction indicated by arrow A3. When the air is sucked from the air tube 19 by a suction pump 81, the air in the detection tank 262 is sucked in a direction indicated by arrow A1, and consequently the air flows into the detection tank 262 in a direction indicated by arrow A2. Accordingly, an airflow from the open end 19*e* to the open end 19*d* occurs in the detection tank 262. The vane wheel 261 is rotated in the direction of A3 by the thus generated airflow.

On the support 263, an optical sensor as a form of a rotation-amount detecting portion of the invention is disposed. The optical sensor has a light emitting portion 264 and a light receiving portion 265 that are disposed on the opposite sides of the vanes 261 in the detection tank 262. The detection tank 262 is formed of a material that transmits light L emitted from the light emitting portion 264. The vane wheel 261 is formed of a material that does not transmit the light L. When the vanes 261*b* are not on a path of the light L, the light receiving portion 265 detects the light L. On the other hand, when any one of the vanes 261 is on the path of the light L, the light receiving portion 265 does not detect the light L. Based on a result of the detection by the light receiving portion 265, it is calculated how many times the vanes 261*b* have passed between the light emitting portion 264 and the light receiving portion 265 per unit time. Based on the thus obtained the number of times of passing of the vanes 261*b* per unit time, a rotation amount of the vane wheel 261 per unit time is calculated. The rotation amount of the vane wheel 261 per unit time corresponds to an airflow rate in the detection tank 262. Thus, it is possible to detect the airflow rate in the detection tank 262 on the basis of the result of the detection by the light receiving portion 265. The vane wheel 261, the light emitting portion 264, and the light receiving portion 265 cooperate to constitute a gas-flow rate detector. The result of the detection by the light receiving portion 265 is outputted to a control unit 100.

The rotation amount of the vane wheel 261 may be detected otherwise, that is, it may be arranged such that the shaft 261*a* of the vane wheel 261 is connected with an encoder that detects the rotation amount of the shaft 261*a*.

Figure 15A:
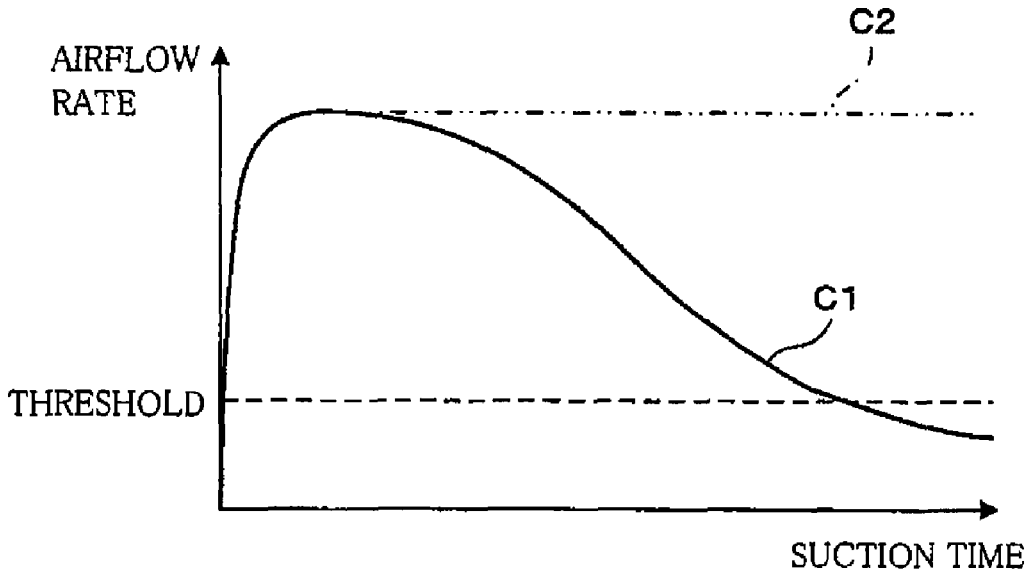
FIG. 15A is a graph of a gas flow rate as detected by the pressure detecting device of FIGS. 14A and 14B, plotted against suction time.
Figure 15B:
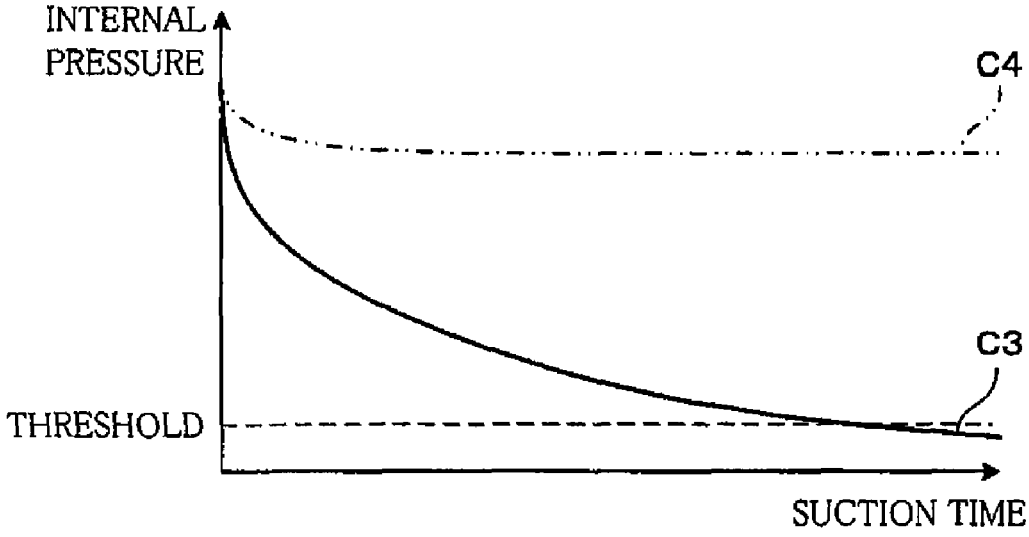
FIG. 15B is a graph of an internal pressure of a detection tank of the pressure detecting device, plotted against suction time.

The control unit 100 implements the following control on the basis of the result of the detection by the light receiving portion 265. FIG. 15A is a graph indicating a relationship between time during which the suction pump 81 continues sucking the air from the air tube 19, and airflow rate in the detection tank 262. FIG. 15B is a graph indicating time during which the suction pump 81 continues sucking the air in the detection tank 262 via the air tube 19, and internal pressure of the detection tank 262. As indicated by curve C3 in FIG. 15B, when the internal pressure of the detection tank 262 decreases as the air is sucked from the air tube 19, the airflow rate in the detection tank 262 changes as indicated by curve C1 in FIG. 15A. That is, when the suction pump 81 starts sucking, the airflow rate in the detection tank 262 first increases. However, as the air is sucked from the detection tank 262 progresses, the internal pressure of the detection tank 262 decreases, along with the airflow rate. When the internal pressure of the detection tank 262 decreases below a threshold, the airflow rate also decreases below a threshold corresponding to the threshold for the internal pressure.

Hence, when it is determined on the basis of the result of the detection by the light receiving portion 265 that the airflow rate in the detection tank 262 changes as indicated by curve C1, the suction control portion 102 of the control unit 100 has the suction pump 81 continue sucking the air until the airflow rate in the detection tank 262 decreases below the threshold. In this way, the air can be sucked from an air chamber 51 until an internal pressure of the air chamber 51 decreases below a first predetermined threshold.

On the other hand, when any one of main tanks 5*a*-5*d* is empty or depleted, the air flows from the empty main tank to the detection tank 262 via ink storage chambers 41-44, the air chamber 51, and the air tube 19. Hence, to continue sucking the air from the detection tank 262 does not decrease the internal pressure of the detection tank 262, as indicated by curve C4, with the airflow rate in the detection tank 262 being held at a level, as indicated by curve C2.

Thus, when it is determined on the basis of the result of the detection by the light receiving portion 265 that the airflow rate in the detection tank 262 does not decrease but is held at a level as indicated by curve C2, a remaining-amount determining portion 103 of the control unit 100 determines that an ink in any one of the main tanks 5*a*-5*d* is depleted. In this case, which main tank is depleted can be determined on the basis of a result of detection by remaining-amount detecting devices 6*a*-6*d* and/or the number of times ink droplets have been ejected.

Similar to the processings illustrated in FIGS. 9 and 10, the air-chamber suction processing may be implemented before initiation of the nozzle maintenance processing or the recording processing, on the basis of the result of the detection by the light receiving portion 265. For instance, a recording control portion 101 implements the air-chamber suction processing before initiation of the recording processing. Only after it is determined on the basis of the result of the detection by the light receiving portion 265 that the airflow rate in the detection tank 262 decreases below the threshold, the recording control portion 101 initiates the recording processing. According to this arrangement, it is ensured that the recording processing is initiated after the internal pressure of the air chamber 51 is decreased below the first threshold.

Figure 16:
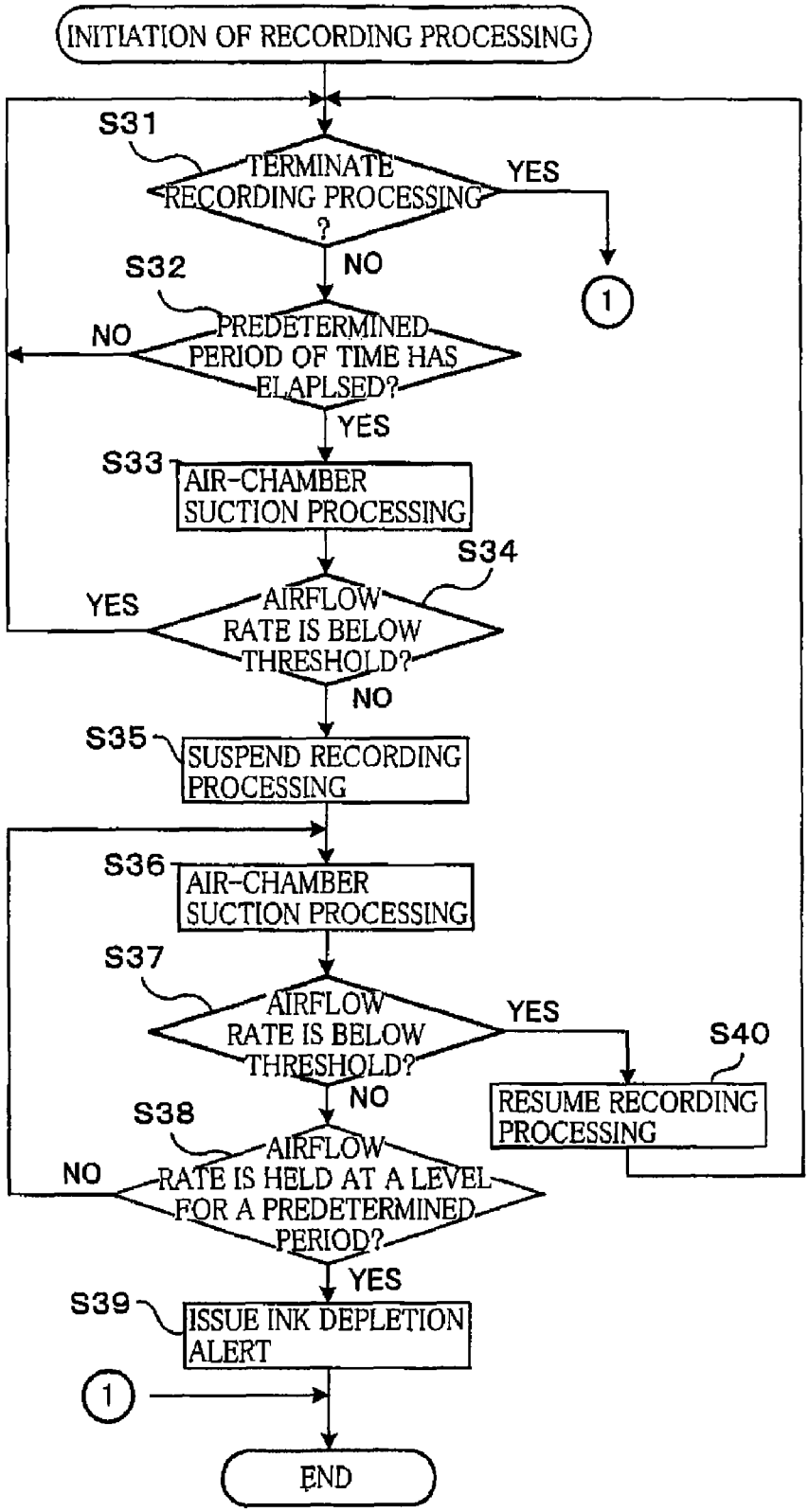
FIG. 16 is a flowchart illustrating a processing implemented during a recording processing on the basis of a result of detection by the pressure detecting device of FIGS. 14A and 14B.

The control unit 100 may implement a processing illustrated in FIG. 16 on the basis of the result of the detection by the light receiving portion 265, after initiation of the recording processing. There will be described the processing of FIG. 16. After a recording processing is initiated, the recording control portion 101 of the control unit 100 determines whether to terminate the recording processing or not to terminate the recording processing, in step S31. When the recording control portion 101 determines that the recording processing should be terminated, an affirmative decision (YES) is made in step S31 and the processing flow is terminated. On the other hand, when the recording control portion 101 determines that the recording processing should not be terminated, a negative decision (NO) is made in step S31 and the processing flow goes to step S32 to continue the recording processing until a predetermined period of time elapses. When it is determined that the period of time has elapsed, an affirmative decision (YES) is made in step S32 and the processing flow goes to step S33 in which the suction control portion 102 implements the air-chamber suction processing while the recording control portion 101 is implementing the recording processing. In step S34, the control unit 100 determines on the basis of the result of the detection by the light receiving portion 265 whether the airflow rate in the detection tank 262 is below the threshold. When the control unit 100 determines that the airflow rate is below the threshold, an affirmative decision (YES) is made in step S34, and the recording control portion 101 continues to implement the recording processing.

On the other hand, when the control unit 100 determines that the airflow rate is not below the threshold, a negative decision (NO) is made in step S34 and the recording control portion 101 temporarily suspends the recording processing in step S35. Meanwhile, the suction control portion 102 continues the air-chamber suction processing (step S36), and again determines in step S37 on the basis of the result of the detection by the light receiving portion 265 whether the airflow rate in the detection tank 262 is below the threshold. When the suction control portion 102 determines that the airflow rate is below the threshold, an affirmative decision (YES) is made in step S37, and the processing flow goes to step S40 in which the recording control portion resumes the recording processing, and then returns to step S31. On the other hand, when the suction control portion 102 determines that the airflow rate is not below the threshold, a negative decision (NO) is made in step S37 and the processing flow goes to step S38 in which the remaining-amount determining portion 103 determines whether the airflow rate is held at a level for a predetermined period of time. When an affirmative decision (YES) is made in step S38, that is, when it is determined that the airflow rate is held at a level for a predetermined period of time, the remaining-amount determining portion 103 determines that any one of the main tanks 5*a*-5*d* is depleted, and the processing flow goes to step S39 in which the control unit 100 issues an alert to a user. In this case, the recording control portion 101 ceases the recording processing. On the other hand, when a negative decision (NO) is made in step S38, that is, when it is determined that the airflow rate is not held at a level for a predetermined period of time, the processing flow returns to step S36 and the suction control portion 102 continues the air-chamber suction processing.

In this way, when the internal pressure of the air-chamber 51 becomes above the first threshold during a recording processing, the recording processing is suspended and the internal pressure is promptly restored below the first threshold. Since the recording processing is suspended when it is detected that the internal pressure is not below the first threshold, it is prevented that the air flows into a head mainbody 30 due to continuation of the recording processing even when it is detected that the internal pressure is not below the first threshold. Further, when any one of the main tanks 5*a*-5*d* is depleted during a recording processing, the user can be promptly informed of this fact.

Figure 17:
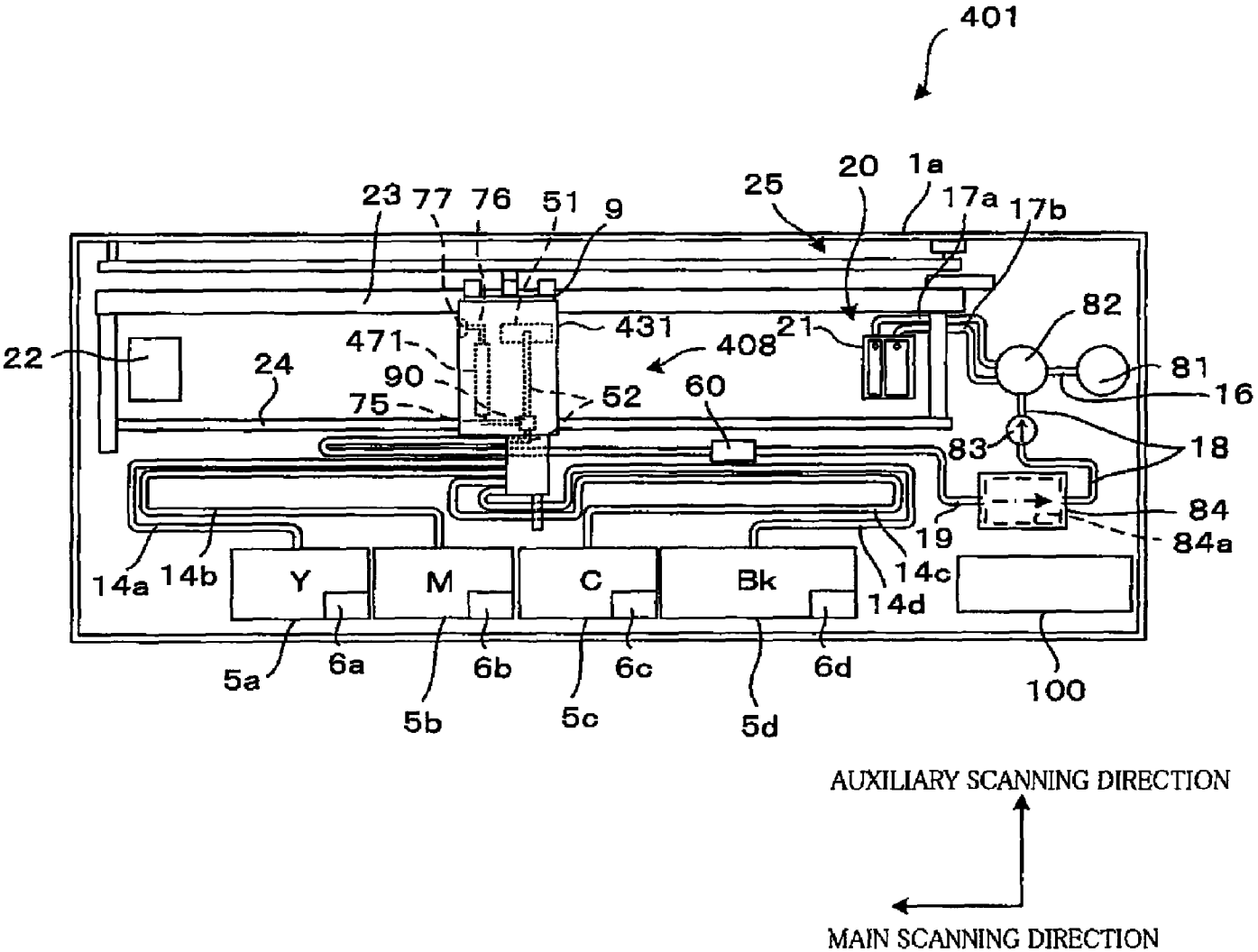
FIG. 17 is a plan view of an inkjet printer according to a fifth embodiment.
Figure 18:
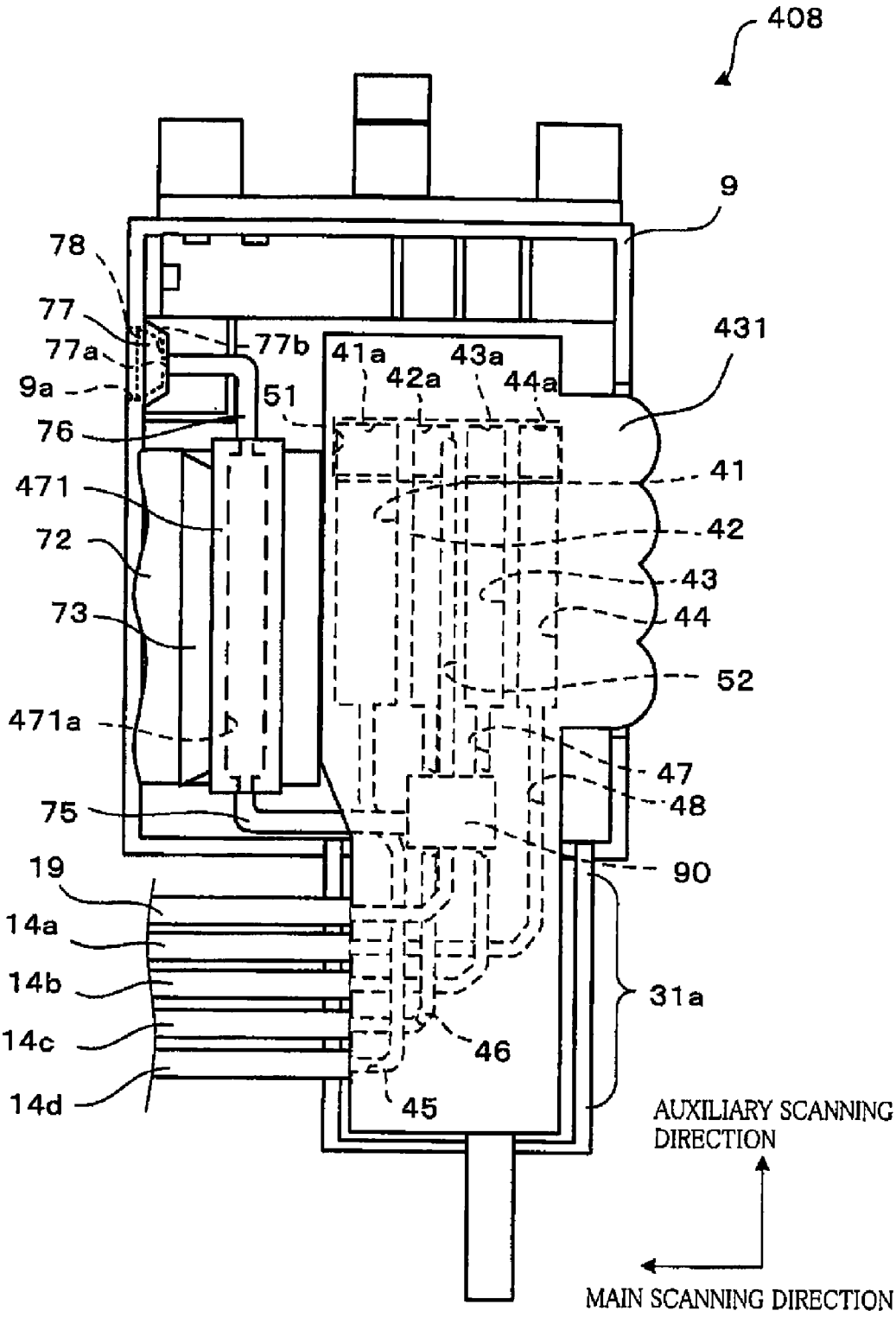
FIG. 18 is a plan view of an inkjet head of the inkjet printer shown in FIG. 17, in a state where a head cover is removed.

Referring to FIGS. 17-19, there will be described an inkjet printer according to a fifth embodiment of the invention, which is generally denoted by reference numeral 401. In FIG. 17, a part of an internal structure of a carriage 9 of the inkjet printer 401 is indicated by broken line, but a head mainbody 30, ink storage chambers 41-44, and others disposed in a lower portion of the carriage 9 are not shown for facilitating comprehension.

Unlike the inkjet printer 1 of the first embodiment, the inkjet printer 401 of the sixth embodiment does not include the pressure limiter 69, but includes a pressure control device 90 instead. Similar to the first embodiment, in this embodiment when an internal pressure of an air chamber 51 becomes equal to or higher than a predetermined first threshold, a suction pump 81 sucks the air from the air chamber 51 so as to decrease the internal pressure thereof below the first threshold. At this time, there is a possibility that the internal pressure of the air chamber 51 excessively decreases below a second threshold lower than the first threshold. The pressure control device 90 operates to prevent such an excessive decrease in the internal pressure of the air chamber 51, as described later. The inkjet printer 401 further includes a heatsink 471 and a mist catching device 77 each in communication with the pressure control device 90. There will be described structures of the pressure control device 90, heatsink 471, and mist catching device 77. FIG. 18 is a plan view of an inkjet head 408 of the inkjet printer 401 in a state where a head cover is removed. As shown in FIGS. 17 and 18, the pressure control device 90 is disposed in a sub tank 431 and at a point in an air passage 52. An inner space of the pressure control device 90 is communicated with the air passage 52, and also with an inner space of the heatsink 471 through an air tube 75.

Figure 19A:
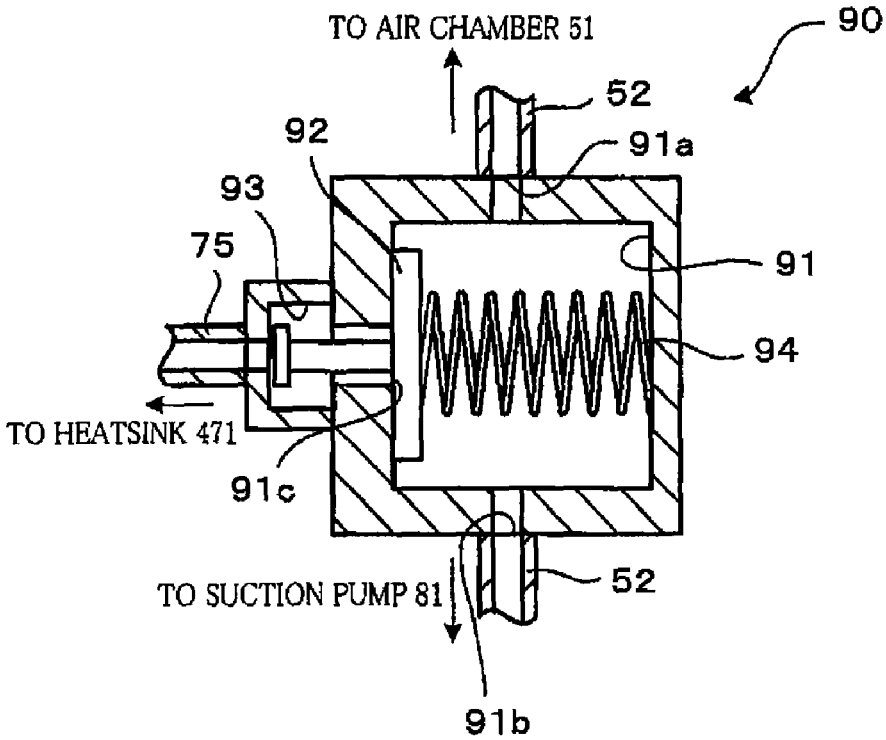
FIGS. 19A and 19B are horizontal cross-sectional views of a pressure control device shown in FIG. 17.
Figure 19B:
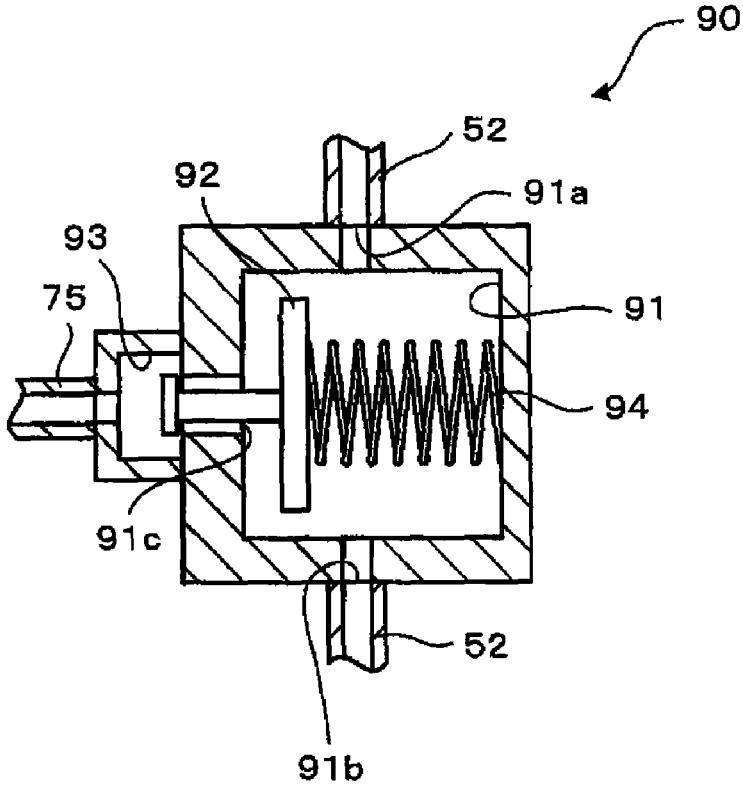

FIGS. 19A and 19B are horizontal cross-sectional views of the pressure control device 90, inside which a pressure control chamber 91 is formed. The pressure control chamber 91 has three ports 91*a*, 91*b* and 91*c*. With the port 91*a*, a part of the air passage 52 on the side of the air chamber 51 is communicated. With the port 91*b*, the other part of the air passage 52 on the side of the suction pump 81 is communicated. With the port 91*c*, the air tube 75 is communicated via a valve chamber 93. In the pressure control chamber 91, a biasing member 94 and a part of a valve element 92 are accommodated. The valve element 92 is disposed to extend through a communication portion at which the pressure control chamber 91 and the valve chamber 93 can communicate with each other. The valve element 92 is movable between a closing position (shown in FIG. 19A) to close the port 91*c*, and an opening position (shown in FIG. 19B) to open the port 91*c*.

The biasing member 94 biases the valve element 92 to the closing position with a biasing force that is set such that the valve element 92 moves between the opening position and the closing position in accordance with a difference between internal pressures of the pressure control chamber 91 and the valve chamber 93. More specifically, the biasing force of the biasing member 94 is set such that when the internal pressure of the pressure control chamber 91 is below the first threshold and equal to or higher than the second threshold lower than the first threshold, the valve element 92 is held at the closing position, and when the internal pressure of the pressure control chamber 91 decreases below the second threshold, the valve element 92 moves to the opening position. That is, as fully described later, an internal space of the valve chamber 93 is open to the external space of the inkjet head 408 via the mist catching device 77, and the pressure in the internal space of the valve chamber 93 (i.e., the internal pressure of the valve chamber 93) is held at the atmospheric pressure, for instance. When the air is sucked from the pressure control chamber 91 and the internal pressure thereof decreases to the second threshold, the difference between the internal pressures of the valve chamber 93 and the pressure control chamber 91 becomes so large as to make the biasing member 94 unable to hold the valve element 92 at the closing position against the pressure difference, and thus the valve element 92 moves from the closing position to the opening position. In this way, when the internal pressure of the pressure control chamber 91 decreases below the second threshold, the valve element 92 moves to the opening position and the air is introduced from the external space of the inkjet head 408 into the pressure control chamber 91 through the valve chamber 93. This increases the internal pressure of the air chamber 51 that is in communication with the pressure control chamber 91. When the internal pressure of the pressure control chamber 91 increases back to a level equal to or higher than the second threshold, the biasing member 94 operates to move the valve element 92 to the closing position against the difference between the internal pressures of the valve chamber 93 and the pressure control chamber 91, and thus the port 91*c* is closed. In this way, the port 91*c* is switchable between an open state and a closed state in accordance with the internal pressure of the pressure control chamber 91. On the other hand, the openings 91*a* and 91*b* are always in an open state, that is, the part of the air passage 52 on the side of the air chamber 51 and the other part of the air passage 52 on the side of the suction pump 81 are held communicated with each other across or via the pressure control chamber 91.

As shown in FIGS. 17 and 18, the inkjet head 408 of the sixth embodiment has the heatsink 471 in place of the heatsink 71 used in the first embodiment. The heatsink 471 is formed of metal and has the shape of a substantially rectangular parallelepiped that is long in an auxiliary scanning direction. Inside the heatsink 471 is formed a void 471*a* extending along the auxiliary scanning direction. Two openings are formed at two opposite ends of the heatsink 471 in the auxiliary scanning direction. With one of the two openings of the void 471*a*, an end of the air tube 75 is connected. With the other opening of the void 471*a* is connected an end of an air tube 76 the other end of which is connected with the mist catching device 77 that is fixed on an inner surface of the carriage 9. The mist catching device 77 has an inner space 77*b* having an opening 77*a*, which faces toward an internal space of the carriage 9 and through which the inner space 77*b* is in communication with an inner space of the air tube 76. Through a thickness of a side wall of the carriage 9, a communication hole 9*a* is formed to be in communication with the inner space 77*b* of the mist catching device 77. The communication hole 9*a* is open to the external space of the carriage 9, that is, to the external space of the inkjet head 408. In the communication hole 9*a*, a filter 78 formed of a porous material or others is attached, that is, a communication portion at which the side wall of the carriage 9 and the inner space 77*b* of the mist catching device 77 are connected with each other is covered by the filter 78.

According to the sixth embodiment, when the internal pressure of the pressure control chamber 91 of the pressure control device 90 becomes lower than the second threshold, the port 91*c* is opened. Since the port 91*c* is in communication with the external space of the inkjet head 408 through the air tube 75, the void 471*a* of the heatsink 471, the air tube 76, and the mist catching device 77, the air is introduced from the external space of the inkjet head 408 into the pressure control chamber 91 from the port 91*c*, to increase the internal pressure of the air chamber 51. When the thus increased internal pressure of the air chamber 51 becomes equal to or higher than the second threshold, the port 91*c* is closed and the internal pressure of the pressure control chamber 91 stops rising. Thus, even when the internal pressure of the air chamber 51 decreases below the second threshold, for instance due to excessive sucking of the air chamber 51 during an air-chamber suction processing, the pressure control device 90 operates to introduce the air from the external space of the inkjet head 408. Hence, it is prevented that the internal pressure of the air chamber 51 excessively decreases, and thus it is prevented that an excessive load is imposed on a gas-permeable film 53 disposed at a communication portion where the air chamber 51 and the ink storage chambers 41-44 communicate with each other. Thus, detachment and damage of the gas-permeable film which may be otherwise caused by an excessive load imposed thereon are prevented.

According to the pressure control device 90, when the port 91*c* is opened, the air is taken in from the external space of the inkjet head 408 through the mist catching device 77. The filter 78 of a porous material is attached at the communication portion at which the mist catching device 77 is connected with the side wall of the carriage 9. When ink droplets are ejected from nozzles 30*a* during a recording operation, a large number of minute ink droplets may waft around the inkjet head 408, in other words, so-called "ink mist" may occur. When the ink mist enters the inkjet head 408 and contacts an electric circuit or others, a short circuit or a malfunction of an ejection actuator 30*b* may occur. However, according to the sixth embodiment, when the air is taken in through the mist catching device 77, the ink mist is sucked in with the air, thereby reducing the ink mist wafting around the inkjet head 408. Further, since the filter 78 attached at the communication portion at which the mist catching device 77 is connected with the side wall of the carriage 9 catches the ink mist, clogging of the air tube 75 or the void 471*a* of the heatsink 471 due to the ink mist flowing thereinto is prevented. Since sucking by the suction pump 81 is utilized to catch the ink mist, it is unnecessary to dispose a suction pump dedicated to catching the ink mist.

The air that is introduced through the mist catching device 77 while the port 91*c* is open then passes through the void 471*a* in the heatsink 471. Hence, heat having been transferred to the heatsink 471 from a driver circuit board 73 is drawn or removed from the heatsink 471 by the air flow through the void 471*a*. Since the void 471*a* is formed along a direction of extension of the driver circuit board 73 (i.e., the auxiliary scanning direction), the heat generated by the driver circuit board 73 is efficiently removed. Further, since sucking by the suction pump 81 is utilized for the removal of the heat from the heatsink 471, it is unnecessary to dispose a suction pump dedicated to cooling the heatsink 471.

It is possible to continuously operate the suction pump 81 so as to continue cooling the heatsink 471 as well as catching the ink mist by the mist catching device 77.

In the sixth embodiment, via the port 91*c* the pressure control chamber 91 is in communication with the internal spaces of the heatsink 471 and the mist catching device 77, more specifically, the void 471*a* of the heatsink 471 and the inner space 77*b* of the mist catching device 77. However, it may be modified such that the pressure control chamber 91 is in communication with only one, or neither, of the internal spaces of the heatsink 471 and the mist catching device 77. Where the pressure control chamber 91 is in communication with neither of the internal spaces, the pressure control chamber 91 is merely open to the external space of the pressure control device 90. Further, it may be modified such that the end of the air tube 75, which is communicated with the void 471*a* of the heatsink 471 in the sixth embodiment, is not in communication with the void 471*a* but is disposed in the vicinity of a surface of the heatsink 471.

In the first to sixth embodiments, a single suction pump 81 can implement both of the nozzle maintenance processing and the air-chamber suction processing. However, a suction pump may be provided for each of the nozzle maintenance processing and the air-chamber suction processing.

The remaining-amount determination processing in the first to sixth embodiments may be modified such that in the remaining-amount determination processing, merely it is determined whether at least one of the main tanks 5*a*-5*d* is depleted, on the basis of only the result of the detection by the pressure detecting device 60, 160, 260, 360.

In the first to sixth embodiments, the flushing processing may be initiated after the air has been sufficiently sucked from the air chamber 51, which fact is determined based on the result of the detection by the pressure detecting device 60.

In the above-described embodiments, a single gas-permeable film 53 is attached to cover all the communication holes 41*a*-44*a*. However, two or more gas-permeable films may be attached. For instance, it may be arranged such that four gas-permeable films are attached to cover the respective communication holes 41*a*-44*a*.

In the above-described embodiments, the sub tank 31 has the tank mainbody 31*b* and the lid member 31*c*. However, the tank mainbody 31*b* and the lid member 31*c* may be integrally formed.

The inkjet printers of the above-described embodiments are the type in which the head mainbody 30 and the sub tank 31 move with the carriage 9. However, the inkjet printers may be the type where an inkjet head is fixed in position. Further, the invention is applicable to apparatuses other than an inkjet printer, that is, apparatuses ejecting various kinds of liquids that are not ink. For instance, the invention is applicable to an apparatus for applying a coloring liquid used in production of a color filter of a liquid crystal display device. As a method of giving ejection energy for the inks in the head mainbody 30, a thermal method may be employed.

In the above-described embodiments, the check valve 83, 183 is disposed to hold the internal pressure of the air chamber 51 below the first threshold. However, in place of the check valve 83, 183, an opening-and-closing means capable of disconnecting and establishing communication between the suction pump 81 and the air chamber 51 may be disposed in the suction passage between the suction pump 81 and the air chamber 51. For instance, such an opening-and-closing means may be disposed in a communication portion where the suction pump 81 and the air tube 16 as a portion of the suction passage are communicated with each other. When the suction pump 81 sucks the air from the air chamber 51, the opening-and-closing means is controlled to communicate the suction pump 81 and the air chamber 51 with each other, and when the suction pump 81 stops sucking the air from the air chamber 51, the opening-and-closing means is controlled to disconnect the communication between the suction pump 81 and the air chamber 51. Thus, even after the suction pump 81 stops sucking, the internal pressure of the air chamber 51 is held below the threshold.

In the above-described embodiments, the sub tank 31 is mounted on the carriage 9. However, it may be modified such that the sub tank 31 is not mounted on the carriage 9 but is disposed at a point in the ink supply passage between the main tanks 5*a*-5*d* and the carriage 9. Although in the above-described embodiments the suction pump 81 sucks the air from the air chamber 51 that is formed in the sub tank 31, the suction passage of the suction pump 81 (i.e., the suction passage corresponding to the first suction passage of the invention) may be connected to the ink supply passage at any point between the main tanks 5*a*-5*d* and the head mainbody 30 so as to suck the air therefrom.

Figure 20:
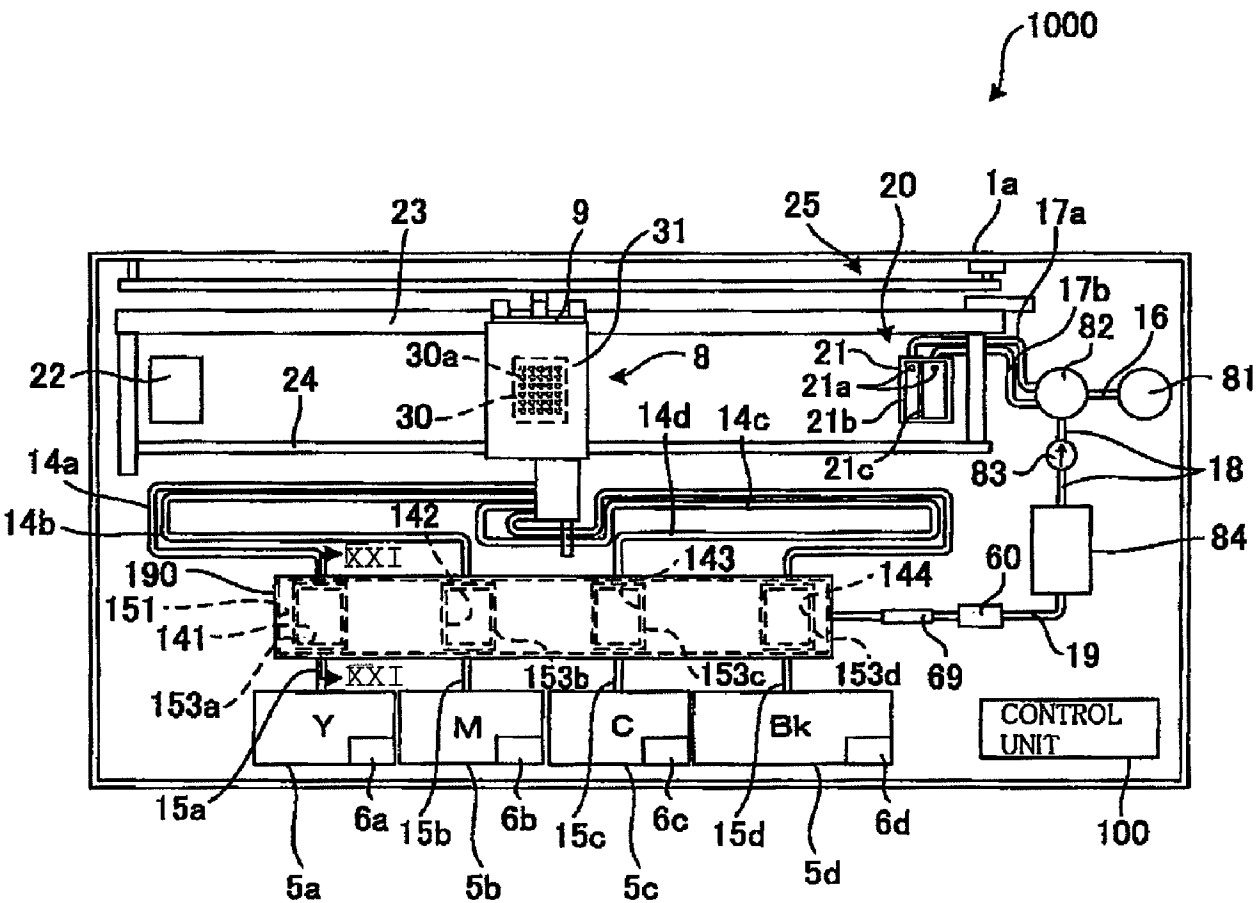
FIG. 20 is a plan view of an inkjet printer according to a sixth embodiment in which a suction passage extending from a suction pump differs from that of the first embodiment.
Figure 21:
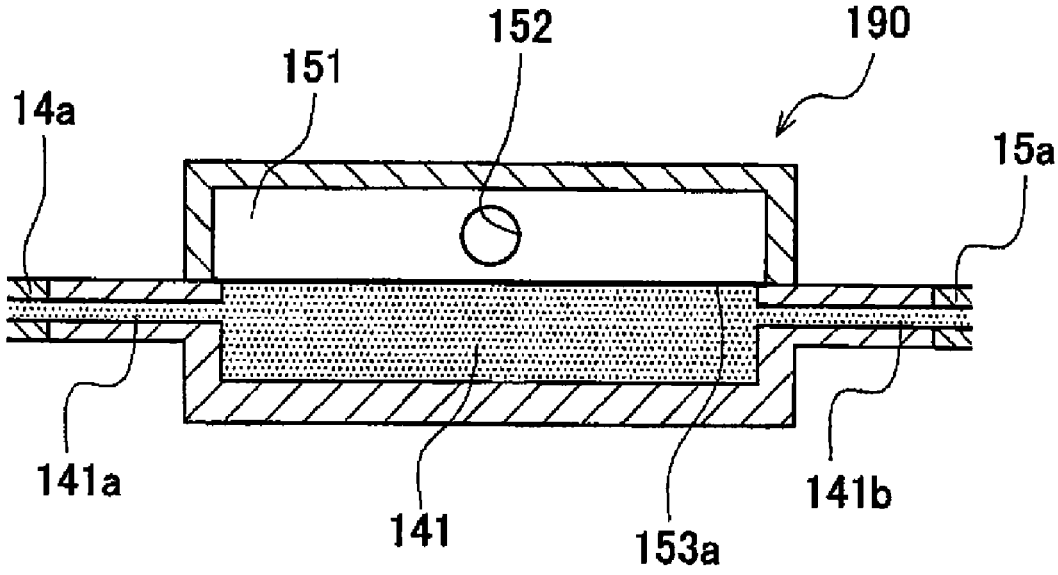
FIG. 21 is a cross-sectional view taken along line XXI-XXI in FIG. 20.

As an example where the suction passage of the suction pump 81 is connected to the ink supply passage at a point other than the sub tank, there will be described an inkjet printer according to a sixth embodiment of the invention, with reference to FIGS. 20 and 21. FIG. 21 is a vertical cross sectional view taken along line XXI-XXI in FIG. 20, and shows an ink chamber 141 and its vicinity. Ink chambers 142-144 having the same vertical cross section as that of the ink chamber 141 are not shown. As shown in FIG. 20, in which reference numeral 1000 generally denotes the inkjet printer of the seventh embodiment, an air ejecting device 190 is disposed between main tanks 5*a*-5*d* and ink tubes 14*a*-14*d*. Inside the air ejecting device 190, ink chambers 141-144 and an air chamber 151 are formed. The ink tubes 14*a*-14*d* are in communication with the ink chambers 141-144 at an upper portion of the air ejecting device 190 as seen in FIG. 20. The main tanks 5*a*-5*d* are in communication with the ink chambers 141-144 via respective ink tubes 15*a*-15*d*. Inks in the main tanks 5*a*-5*d* are supplied to a sub tank 31 via the ink tubes 15*a*-15*d*, the ink chambers 141-144, and the ink tubes 14*a*-14*d*.

As shown in FIG. 21, the ink chamber 141 is connected at a left end thereof with the ink tube 14*a* through a communication opening 141*a*, and is connected at a right end thereof with the ink tube 15*a* through a communication opening 141*b*. Similarly, the ink chambers 142-144 are connected with the ink tubes 14*b*-14*d* and 15*b*-15*d*. The air chamber 151 extends above and across the ink chambers 141-144, as shown in FIG. 20. The air chamber 151 is connected with an air tube 19 through a communication hole 152, and the air chamber 151 and a charge tank 84 are connected with each other through the air tube 19. As seen in FIG. 20, the communication hole 152 is disposed at a right end of the air ejecting device 190.

As shown in FIGS. 20 and 21, at communication portions at which the ink chambers 141-144 are respectively communicated with the air chamber 151, respective gas-permeable films 153*a*-153*d* are disposed. The gas-permeable films 153*a*-153*d* are located to overlap the ink chambers 141-144 in plan view, as shown in FIG. 20, and constitute walls separating the ink chambers 141-144 from the air chamber 151. In the present embodiment, a gas-permeable film is disposed for each of the ink chambers 141-144. However, it may be modified such that a single gas-permeable film is disposed to extend across the ink chambers 141-144.

According to the air ejecting device 190 of this embodiment, the air in the ink chambers 141-144 is ejected to the air chamber 151 by passing through the gas-permeable films 153*a*-153*d*, and then ejected from the air chamber 151 to the air tube 19. In this embodiment, an air or suction passage extending from the air chamber 151 to the suction pump 81 through the air tube 19, the charge tank 84, and air tubes 18 corresponds to the first suction passage of the invention.

Although there have been described several embodiments of the invention, it is to be understood that the invention is not limited to the details of the embodiments, but may be otherwise embodied with various modifications and improvements that may occur to those skilled in the art, without departing from the scope and spirit of the invention defined in the appended claims.

What is claimed is:

1. A liquid-droplet ejecting apparatus comprising:

a liquid ejecting head having an ejection opening from which a droplet of a liquid is ejected;

a liquid supply passage through which the liquid is supplied to the liquid ejecting head;

a first suction passage normally held in communication with the liquid supply passage;

a sucking device which sucks a gas in the liquid supply passage via the first suction passage;

a gas-permeable film disposed at a communication portion at which the liquid supply passage and the first suction passage communicate with each other, the gas-permeable film allowing the gas to pass therethrough but not allowing the liquid to pass therethrough;

a gas tank which is disposed in a portion of the first suction passage between the sucking device and the liquid supply passage, and accommodates the gas to accumulate a suction pressure to suck the gas; and a check valve which is disposed in a portion of the first suction passage between the sucking device and the gas tank, and allows the gas to flow in a first direction from the liquid supply passage to the sucking device, but does not allow the gas to flow in a second direction opposite to the first direction, wherein the check valve includes a valve element movable between an opening position to open the first suction passage and a closing position to close the first suction passage, in accordance with a difference between a pressure acting from the side of the sucking device and a pressure acting from the side of the liquid supply passage.

2. The apparatus according to claim 1, further comprising:

an ejection-opening capping device which includes a cap movable relative to the liquid ejecting head, between a covering position to closely contact the liquid ejecting head in order to air-tightly cover the ejection opening, and an uncovering position to uncover the ejection opening;

a second suction passage having two opposite ends, one of the two opposite ends being in communication with an internal space of the cap, and the sucking device sucks the gas from the other of the two opposite ends;

a switching device which selectively connects the sucking device with one of the first suction passage and the second suction passage; and a suction controller which controls the ejection-opening capping device, the sucking device, and the switching device so as to implement an ejection-opening suction processing in which the liquid in the liquid ejecting head is sucked from the ejection opening and via the second suction passage, and controls the sucking device and the switching device so as to implement a passage suction processing in which the gas is sucked from the liquid supply passage via the first suction passage.

3. The apparatus according to claim 2, further comprising a pressure detecting device which detects whether an internal pressure of the first suction passage is below a first predetermined threshold or not, and wherein the suction controller controls at least one of the ejection-opening capping device, the sucking device, and the switching device on the basis of a result of the detection by the pressure detecting device.

4. The apparatus according to claim 3, wherein the first suction passage has a tube, at least a part of which is formed of an elastic material, wherein the pressure detecting device includes a detected member which is disposed adjacent to the part of the tube, and a sensor which detects whether the detected member is located at a predetermined detection position, and wherein the tube expands to push the detected member toward the detection position when an internal pressure thereof becomes relatively high.

5. A liquid-droplet ejecting apparatus comprising:

a liquid ejecting head having an ejection opening from which a droplet of a liquid is ejected;

a liquid supply passage through which the liquid is supplied to the liquid ejecting head;

a first suction passage normally held in communication with the liquid supply passage;

a sucking device which sucks a gas in the liquid supply passage via the first suction passage;

a gas-permeable film disposed at a communication portion at which the liquid supply passage and the first suction passage communicate with each other, the gas-permeable film allowing the gas to pass therethrough but not allowing the liquid to pass therethrough;

a gas tank which is disposed in a portion of the first suction passage between the sucking device and the liquid supply passage, and accommodates the gas to accumulate a suction pressure to suck the gas; and a check valve which is disposed in a portion of the first suction passage between the sucking device and the gas tank, and allows the gas to flow in a first direction from the liquid supply passage to the sucking device, but does not allow the gas to flow in a second direction opposite to the first direction, an ejection-opening capping device which includes a cap movable relative to the liquid ejecting head, between a covering position to closely contact the liquid ejecting head in order to air-tightly cover the ejection opening, and an uncovering position to uncover the ejection opening;

a second suction passage having two opposite ends, one of the two opposite ends being in communication with an internal space of the cap, and the sucking device sucks the gas from the other of the two opposite ends;

a switching device which selectively connects the sucking device with one of the first suction passage and the second suction passage; and a suction controller which controls the ejection-opening capping device, the sucking device, and the switching device so as to implement an ejection-opening suction processing in which the liquid in the liquid ejecting head is sucked from the ejection opening and via the second suction passage, and controls the sucking device and the switching device so as to implement a passage suction processing in which the gas is sucked from the liquid supply passage via the first suction passage, a pressure detecting device which detects whether an internal pressure of the first suction passage is below a first predetermined threshold or not, and wherein the suction controller controls at least one of the ejection-opening capping device, the sucking device, and the switching device on the basis of a result of the detection by the pressure detecting device, a liquid tank from which the liquid is supplied to the liquid supply passage; and a remaining-amount determining portion which has the suction controller implement the passage suction processing when the pressure detecting device detects that the internal pressure of the first suction passage is not below the first predetermined threshold, the remaining-amount determining portion determining that the liquid tank is empty when the pressure detecting device again detects that the internal pressure of the first suction passage is not below the first predetermined threshold after the implementation of the passage suction processing by the suction controller.

6. The apparatus according to claim 5, comprising a plurality of the liquid tanks and a plurality of remaining-amount detecting devices provided to the respective liquid tanks in order to detect whether amounts of the liquid in the respective liquid tanks are below a threshold near zero, and wherein the remaining-amount determining portion has the suction controller implement the passage suction processing when the pressure detecting device detects that the internal pressure of the first suction passage is not below the first predetermined threshold, the remaining-amount determining portion determining that one of the liquid tanks is empty, when the pressure detecting device detects that the internal pressure of the first suction passage is not below the first predetermined threshold even after the implementation of the passage suction processing by the suction controller, and one of the remaining-amount detecting devices corresponding to the one liquid tank detects that an amount of the liquid remaining in the one liquid tank is below the threshold.

7. A liquid-droplet ejecting apparatus comprising:

a liquid ejecting head having an ejection opening from which a droplet of a liquid is ejected;

a liquid supply passage through which the liquid is supplied to the liquid ejecting head;

a first suction passage normally held in communication with the liquid supply passage;

a sucking device which sucks a gas in the liquid supply passage via the first suction passage;

a gas-permeable film disposed at a communication portion at which the liquid supply passage and the first suction passage communicate with each other, the gas-permeable film allowing the gas to pass therethrough but not allowing the liquid to pass therethrough;

a gas tank which is disposed in a portion of the first suction passage between the sucking device and the liquid supply passage, and accommodates the gas to accumulate a suction pressure to suck the gas; and a check valve which is disposed in a portion of the first suction passage between the sucking device and the gas tank, and allows the gas to flow in a first direction from the liquid supply passage to the sucking device, but does not allow the gas to flow in a second direction opposite to the first direction, an ejection-opening capping device which includes a cap movable relative to the liquid ejecting head, between a covering position to closely contact the liquid ejecting head in order to air-tightly cover the ejection opening, and an uncovering position to uncover the ejection opening;

a second suction passage having two opposite ends, one of the two opposite ends being in communication with an internal space of the cap, and the sucking device sucks the gas from the other of the two opposite ends;

a switching device which selectively connects the sucking device with one of the first suction passage and the second suction passage; and a suction controller which controls the ejection-opening capping device, the sucking device, and the switching device so as to implement an ejection-opening suction processing in which the liquid in the liquid ejecting head is sucked from the ejection opening and via the second suction passage, and controls the sucking device and the switching device so as to implement a passage suction processing in which the gas is sucked from the liquid supply passage via the first suction passage, and a pressure detecting device which detects whether an internal pressure of the first suction passage is below a first predetermined threshold or not, and wherein the suction controller controls at least one of the ejection-opening capping device, the sucking device, and the switching device on the basis of a result of the detection by the pressure detecting device, wherein the pressure detecting device includes a gas-flow rate detector which detects a gas flow rate in the first suction passage, the pressure detecting device detecting the internal pressure of the first suction passage on the basis of the gas flow rate which is detected by the gas-flow rate detector when the sucking device sucks the gas via the first suction passage.

8. The apparatus according to claim 7, wherein the gas-flow rate detector includes a vane wheel which rotates in accordance with the gas flow in the first suction passage, and a rotation-amount detecting portion which detects an amount of rotation of the vane wheel per unit time.

9. The apparatus according to claim 7, wherein the suction controller continues the passage suction processing until the gas-flow rate detector detects that the gas flow rate becomes below a threshold that corresponds to the first predetermined threshold for the internal pressure.

10. The apparatus according to claim 7, further comprising:

a liquid tank from which the liquid is supplied to the liquid supply passage; and a remaining-amount determining portion which determines an amount of the liquid remaining in the liquid tank, and wherein the remaining-amount determining portion determines that the liquid tank is empty when the gas flow rate in the first suction passage as detected by the gas-flow rate detector does not decrease although the sucking device continues sucking the gas via the first suction passage.

11. The apparatus according to any one of claim 3, wherein the suction controller includes an ejection-opening suction permitting portion which permits to implement the ejection-opening suction processing, when the pressure detecting device detects that the internal pressure of the first suction passage becomes below the first predetermined threshold.

12. The apparatus according to claim 11, wherein when the pressure detecting device detects that the internal pressure of the first suction passage is not below the first predetermined threshold, the suction controller controls to implement the passage suction processing previous to the ejection-opening suction processing.

13. The apparatus according to any one of claim 1, wherein the first suction passage includes a pressure limiter which closes the first suction passage when the internal pressure within the first suction passage decreases to a second predetermined threshold lower than the first predetermined threshold.

14. The apparatus according to claim 13, wherein the pressure limiter comprises a portion of the first suction passage which is flattened by a difference between the internal pressure and an external pressure of the portion of the first suction passage so as to close the first suction passage when the internal pressure of the first suction passage decreases to the second predetermined threshold.

15. The apparatus according to any one of claim 1, further comprising a pressure detecting device which detects whether an internal pressure of the first suction passage is below a first predetermined threshold or not, and a recording controller which implements a recording processing by ejecting a droplet of the liquid from the ejection opening, the recording controller including a recording permitting portion which permits to implement the recording processing when the pressure detecting device detects that the internal pressure of the first suction passage becomes below the first predetermined threshold.

16. The apparatus according to claim 15, wherein when the pressure detecting device detects that the internal pressure of the first suction passage is not below the first predetermined threshold, the suction controller has the sucking device suck the gas from the liquid supply passage before the recording controller starts the recording processing.

17. The apparatus according to claim 1, wherein, when the suction device sucks the gas from the first suction package, the valve element moves to the opening position, and, when the suction device stops sucking the gas from the first suction passage, the valve element moves to the closing position.

* * * * *